US012037720B2

(12) United States Patent
Maehara

(10) Patent No.: US 12,037,720 B2
(45) Date of Patent: Jul. 16, 2024

(54) STRETCHABLE FABRIC, AND MANUFACTURING METHOD AND MANUFACTURING DEVICE FOR SAME

(71) Applicant: KAIHARA CO., LTD., Fukuyama (JP)

(72) Inventor: Akihiro Maehara, Fukuyama (JP)

(73) Assignee: KAIHARA CO., LTD., Hiroshima (JP)

( * ) Notice: Subject to any disclaimer, the term of this patent is extended or adjusted under 35 U.S.C. 154(b) by 328 days.

(21) Appl. No.: 17/435,303

(22) PCT Filed: Mar. 1, 2019

(86) PCT No.: PCT/JP2019/008248
§ 371 (c)(1),
(2) Date: Sep. 1, 2021

(87) PCT Pub. No.: WO2019/139177
PCT Pub. Date: Jul. 18, 2019

(65) Prior Publication Data
US 2022/0042217 A1 Feb. 10, 2022

(51) Int. Cl.
*D03D 15/56* (2021.01)
*A41D 1/06* (2006.01)
(Continued)

(52) U.S. Cl.
CPC ..... *D03D 15/56* (2021.01); *A41D 1/06* (2013.01); *D02G 3/328* (2013.01); *D03D 15/47* (2021.01);
(Continued)

(58) Field of Classification Search
CPC ..... D03D 47/24; D03D 15/16; D03D 15/56; D03D 15/47; D10B 2201/02;
(Continued)

(56) References Cited

U.S. PATENT DOCUMENTS 4,546,799 A 10/1985 Riesen
2006/0060257 A1* 3/2006 Iwashita ..... A41D 31/00 28/167
(Continued)

FOREIGN PATENT DOCUMENTS

CN 108660569 A * 10/2018 ..... D02G 3/04
DE 202011051959 U1 1/2012
(Continued)

OTHER PUBLICATIONS

Machine Translation of JP 06049737 A (Year: 1994).*
(Continued)

*Primary Examiner* — Larissa Rowe Emrich
(74) *Attorney, Agent, or Firm* — Apex Juris, pllc; Tracy M Heims

(57) ABSTRACT

An elastic woven fabric comprising weft and warp yarns, the weft yarns including elastic composite yarns each of which comprises an elastic core yarn and a sheath yarn covering the elastic core yarn, and the warp yarns including chemical fiber yarns and/or natural fiber yarns. Each of the elastic composite yarns is in a form of a singly-covered yarn in which the elastic core yarn is covered by a single layer of the sheath yarn helicoidally wound around a periphery of the elastic core yarn, a number of turns of the sheath yarn per 1 meter of the elastic core yarn being in a range of 1,000 to 2,500 T/m. A stretching magnification ratio of each of the elastic composite yarns, in the elastic woven fabric in a weaving process, is retained equal to or less than 1.30 folds based on the elastic composite yarn before weaving.

23 Claims, 8 Drawing Sheets

(51) Int. Cl.
*D02G 3/32* (2006.01)
*D03D 15/47* (2021.01)
*D03D 47/24* (2006.01)

(52) U.S. Cl.
CPC ..... *D03D 47/24* (2013.01); *D10B 2201/02* (2013.01); *D10B 2331/02* (2013.01); *D10B 2331/04* (2013.01)

(58) Field of Classification Search
CPC .. D10B 2331/02; D10B 2331/04; A41D 1/06; D02G 3/32–328
USPC ..... 428/184
See application file for complete search history.

(56) References Cited

U.S. PATENT DOCUMENTS

| | | | | |
|---|---|---|---|---|
| 2006/0096073 | A1* | 5/2006 | Stoppa | D03D 15/56 28/165 |
| 2007/0259583 | A1* | 11/2007 | Laycock | D02G 3/324 442/184 |
| 2009/0139601 | A1* | 6/2009 | Karayianni | D02G 3/328 139/421 |
| 2012/0270455 | A1 | 10/2012 | Morishita | |
| 2013/0319055 | A1* | 12/2013 | Tatsumi | D04B 1/28 66/174 |
| 2015/0133017 | A1 | 5/2015 | Liao et al. | |
| 2020/0181815 | A1* | 6/2020 | Zhang | A41B 11/14 |

FOREIGN PATENT DOCUMENTS

| | | | | | |
|---|---|---|---|---|---|
| EP | 0729713 | B1 | | 5/2001 | |
| JP | S57-199864 | | | 12/1982 | |
| JP | S60-99044 | | | 6/1985 | |
| JP | S60-209053 | | | 10/1985 | |
| JP | 04024242 | A | * | 1/1992 | D03D 47/278 |
| JP | H0424242 | | | 1/1992 | |
| JP | 06049737 | A | * | 2/1994 | |
| JP | H0649737 | | | 2/1994 | |
| JP | H07-238438 | | | 9/1995 | |
| JP | 2001-303378 | | | 10/2001 | |
| JP | 2004-232095 | | | 8/2004 | |
| JP | 2004232095 | A | * | 8/2004 | A41D 31/00 |
| JP | 2005-120525 | | | 5/2005 | |
| JP | 2005120525 | A | * | 5/2005 | |
| JP | 2011-132644 | | | 7/2011 | |
| JP | 2016141902 | | | 8/2016 | |

OTHER PUBLICATIONS

Derwent English Abstract of JP 04024242 A (Year: 1992).*
Derwent English Abstract of JP 2005120525 A (Year: 2005).*
Japanese Office Action Corresponding to 2019-565134 mailed Apr. 28, 2020.
International Search Report Corresponding to PCT/JP2019/008248 mailed Jun. 4, 2019.
Written Opinion Corresponding to PCT/JP2019/008248 mailed Jun. 4, 2019.
Search Report for EP19738749.1, Issued on Oct. 7, 2022, Total of 9 pages.

* cited by examiner

STRETCHABLE FABRIC, AND MANUFACTURING METHOD AND MANUFACTURING DEVICE FOR SAME

FIELD OF THE INVENTION

The present invention relates to an elastic woven fabric and its producing method and producing apparatus, particularly relates to an elastic woven fabric which has not only excellent elongation properties and elongation recovery properties but also a low washing shrinkage rate, is also excellent in productivity, sewing workability and product designability, and thus is useful for an elastic clothing material such as a stretch denim, a stretch chino cloth and so on used for an elastic clothing such as stretch jeans, stretch chino pants, a sport wear, a supporter, etc., and also relates to a method and apparatus for producing such an elastic woven fabric.

BACKGROUND OF THE INVENTION

Denim fabric is a material for jeans clothing frequently used as street clothes or the like. Recently, a demand for a denim fabric having excellent elasticity increases. However, since a denim fabric is a thick material, large elongation properties and elongation recovery properties are demanded to give elasticity to denim fabric.

Conventionally, in order to give elasticity to a woven fabric like denim, it is proposed to use a core-spun type (core-sheath structure type) composite yarn comprising an elastic core yarn and a sheath yarn made of a cotton yarn or the like covering a periphery of the elastic core yarn, or a side-by-side type composite yarn comprising an elastic yarn and a polyester yarn or the like having high strength which are connected when spinning. For example, JP 2001-303378 A describes a core-sheath structure type composite yarn comprising a core yarn made of a false-twisted yarn which consists of a polytrimethylene terephthalate fiber and has an elastic elongation rate of 100% or more and an elastic modulus of 80% or more, as a composite yarn which has excellent elongation properties and elongation recovery properties and by which a fabric excellent in stretch-back feeling, puff feeling, softness, tensile feeling, stiffness, etc. is obtainable.

However, the polytrimethylene terephthalate fiber yarn is lower in elasticity and an elongation limit than those of a polyurethane elastic fiber yarn having rubber elasticity. Thus, clothes made of a woven fabric in which the polytrimethylene terephthalate fiber yarn is used have problems when a wearer puts on the clothes, the wearer feels difficulty in stretching to motions, and feels a sense of tightness because the clothes cannot follow large motions. Moreover, the woven fabric in which the polytrimethylene terephthalate fiber yarn is used also has a problem that it is comparatively high in a washing shrinkage rate because the polytrimethylene terephthalate fiber yarn has a higher shrinkage rate when immersed in water than that of the polyurethane elastic fiber yarn.

Thereupon, as a woven fabric that has a high stretchability and follows motions when wearing, JP 2016-141902 A proposes a woven fabric comprising weft yarns and warp yarns, wherein the weft yarn is a composite yarn comprising a drafted polyurethane elastic fiber and a cellulosic fiber covering a periphery of the drafted polyurethane elastic fiber, and wherein the warp yarn consists of a cellulosic fiber and/or a synthetic fiber.

However, there has been a problem that when a tension is applied to a composite yarn comprising a polyurethane elastic fiber by a loom, the composite yarn is highly stretched owing to its high elasticity, and that the obtained woven fabric has a high shrinkage rate and deforms when freed from a loom, and its yield is low. When a woven fabric deforms, sewing workability is lowered and a product designability is impaired. Particularly, when the polyurethane elastic fiber of the composite yarn has been previously drafted as the case of JP 2016-141902 A, a woven fabric shrinks by contacting with water in a dyeing process, a washing process and so on. Therefore, the above-mentioned problems become more obvious.

SUMMARY OF THE INVENTION

Accordingly, an object of the present invention is to provide an elastic woven fabric which has not only excellent elongation properties and elongation recovery properties but also a low washing shrinkage rate, and is also excellent in productivity, sewing workability and product designability.

Another object of the present invention is to provide a method for producing an elastic woven fabric which has not only excellent elongation properties and elongation recovery properties but also a low washing shrinkage rate, and is also excellent in productivity, sewing workability and product designability.

A further object of the present invention is to provide an apparatus for producing an elastic woven fabric which has not only excellent elongation properties and elongation recovery properties but also a low washing shrinkage rate, and is also excellent in productivity, sewing workability and product designability.

As a result of intense research in view of the above objects, the inventor has found that when using an elastic composite yarn which has a form of a singly-covered yarn having a number of turns of a sheath yarn per 1 meter of an elastic core yarn in a range of 1,000 to 2,500 T/m and has an elongation rate of equal to or more than 30% and an elastic recovery rate of equal to or more than 70%, and blowing a compressed air flow to the elastic composite yarn in a direction substantially opposite to a feed direction of the elastic composite yarn in a weaving process, it is possible to reduce a tensile force applied to the elastic composite yarn to decrease stretching of the elastic composite yarn in a weaving process, and therefore a degree of the stretching of the elastic composite yarns constituting weft yarns of an elastic woven fabric can be kept low. The present invention has been completed based on such a finding.

Thus, the elastic woven fabric of the present invention comprises weft and warp yarns, the weft yarns including a plurality of elastic composite yarns each of which comprises an elastic core yarn and a sheath yarn covering the elastic core yarn, and the warp yarns including a plurality of chemical fiber yarns and/or a plurality of natural fiber yarns, characterized in that each of the elastic composite yarns is in a form of a singly-covered yarn in which the elastic core yarn is covered by a single layer of the sheath yarn helicoidally wound around a periphery of the elastic core yarn, a number of turns of the sheath yarn per 1 meter of the elastic core yarn being in a range of 1,000 to 2,500 T/m, in that an elongation rate of each of the elastic composite yarns is equal to or more than 30%, in that an elastic recovery rate of each of the elastic composite yarns is equal to or more than 70%, and in that a stretching magnification ratio of each of the elastic composite yarns in the elastic woven fabric in a weaving process is retained equal to or less than 1.30 folds based on the elastic composite yarn before weaving.

The elastic woven fabric of the present invention is useful as an elastic clothing material. When the elastic clothing material of the present invention has a twill weave, this material is useful as a stretch denim and this stretch denim is useful as a material for stretch jeans. When the elastic clothing material of the present invention has a twill weave, this material is useful as a stretch chino cloth, too. This stretch chino cloth is useful as a material for stretch chino pants. Moreover, the elastic clothing material of the present invention is useful as a material for a supporter, particularly for a medical supporter.

A method for producing the elastic woven fabric of the present invention by using a gripper loom, the gripper loom comprising at least a projectile which is flown through a warp shedding in a weft direction with gripping the elastic composite yarn in order to feed the elastic composite yarn and a weft yarn brake which is provided in a feeding side of the elastic composite yarn to apply a tensile force to the elastic composite yarn pulled by the flying projectile, characterized in that the method comprises a step of blowing an air to the elastic composite yarn pulled by the flying projectile by using an air nozzle or an air blower in a direction substantially opposite to the feed direction of the elastic composite yarn in a vicinity of a downstream side of the weft yarn brake, and thereby reducing the tensile force applied by the weft yarn brake to decrease stretching of the elastic composite yarn in a weaving process.

An apparatus for producing the elastic woven fabric of the present invention includes the gripper loom comprising at least a projectile which is flown through a warp shedding in a weft direction with gripping the elastic composite yarn in order to feed the elastic composite yarn and a weft yarn brake which is provided in a feeding side of the elastic composite yarn to apply a tensile force to the elastic composite yarn pulled by the flying projectile, characterized in that the gripper loom comprises an air blowing means for blowing an air to the elastic composite yarn pulled by the flying projectile in a direction substantially opposite to the feed direction of the elastic composite yarn in a vicinity of a downstream side of the weft yarn brake, and thereby reducing the tensile force applied by the weft yarn brake to decrease the stretching of the elastic composite yarn in a weaving process.

According to the present invention, since a degree of stretching of elastic composite yarn for constituting weft yarns of an elastic woven fabric can be kept low, it is possible to obtain an elastic woven fabric which has not only excellent elongation properties and elongation recovery properties but also a low washing shrinkage rate, and is also excellent in productivity, sewing workability and product designability.

EMBODIMENTS OF THE INVENTION

[1] Elastic Woven Fabric

The elastic woven fabric of the present invention comprises weft and warp yarns, the weft yarns including a plurality of elastic composite yarns each of which comprises an elastic core yarn and a sheath yarn covering the elastic core yarn, and the warp yarns including a plurality of chemical fiber yarns and/or a plurality of natural fiber yarns.

Weft Yarn (A) Weft Yarn

The weft yarns include a plurality of the elastic composite yarns described below as a main component. The weft yarns may include at least one kind of elastic yarn other than the elastic composite yarns described below unless impairing the advantages of the present invention. The weft yarns preferably consists of the elastic composite yarns only.

Figure 1:
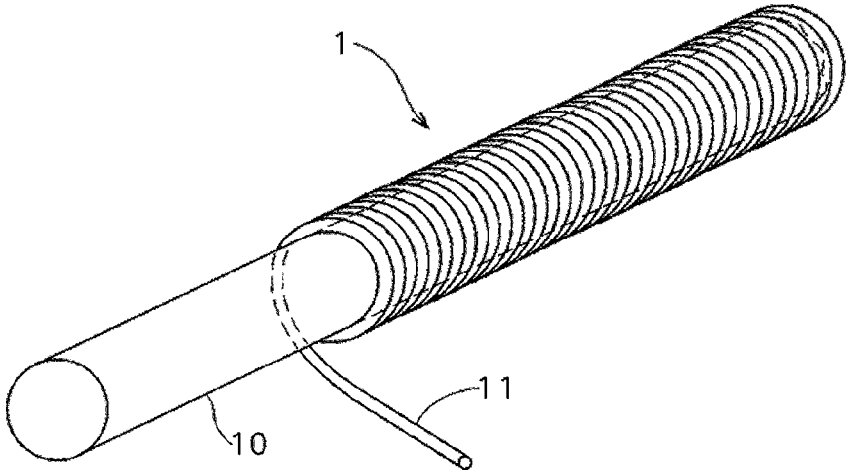
FIG. 1 is a schematic perspective view showing an example of an elastic composite yarn included in an elastic woven fabric of the present invention.

FIG. 1 is a schematic perspective view showing an example of the elastic composite yarn. The elastic composite yarn 1 is in a form of a singly-covered yarn in which the elastic core yarn 10 is covered by a single layer of the sheath yarn 11 helicoidally wound around a periphery of the elastic core yarn 10.

(1) Elastic Core Yarn

The elastic core yarn 10 has a large breaking elongation that when removing a tensile force after the yarn 10 is stretched in a predetermined range, a length of the yarn 10 substantially returns to its initial value. In order to obtain excellent elongation properties and elongation recovery properties of the elastic woven fabric, fineness of the elastic core yarn 10 is preferably equal to or more than 20 dtex, more preferably in a range of 40 to 1,300 dtex, most preferably 300 to 650 dtex.

Specific examples of a fiber for composing the elastic core yarn 10 include a polyurethane fiber, a polyolefin system elastic fiber, a polybutylene terephthalate fiber, a natural rubber fiber, a synthetic rubber fiber, a polyvinylchloride fiber, a polyvinylidene chloride fiber, etc. The polyurethane fiber is preferable from the viewpoints of highness of elongation properties and elongation recovery properties, versatility in a market, etc.

Specific examples of the polyurethane fiber include a polyester system urethane fiber, a polyether system urethane fiber, a copolymer fiber of ester system urethane compound and ether system urethane compound, etc. The polyurethane fiber is typically obtained by spinning elastic polyurethane obtained from a reaction between polyol and organic polyisocyanate. The polyol and the organic polyisocyanate may be those publicly known which are typically used for producing polyurethane. A specific example of the polyol includes diol such as polyether glycol, polyester glycol, polymer diol, etc. Specific examples of the organic polyisocyanate include hexamethylene diisocyanate, diphenylmethane diisocyanate, toluene diisocyanate, etc.

As described above, the elastic core yarn 10 is preferably the polyurethane elastic yarn comprising the polyurethane fiber, wherein the polyurethane elastic yarn may be either form of a monofilament yarn or a multifilament yarn. The elastic core yarn 10 may comprise a mixed fiber of the polyurethane fiber and other elastic fiber unless impairing the advantages of the present invention.

(2) Sheath Yarn

The sheath yarn 11 preferably comprises a water-insoluble fiber which is insoluble in water, particularly in hot water. Provided that the sheath yarn 11 comprises such a water-insoluble fiber, the sheath yarn 11 may be either of the chemical fiber yarn and the natural fiber yarn. Specific examples of the fiber for composing the chemical fiber yarn include a synthetic fiber such as a polyamide (nylon) fiber, a polyester fiber, an acrylic fiber, an acrylic system fiber, a polyolefin fiber, a water (hot water)-insoluble polyvinyl alcohol fiber, etc.; a semisynthetic fiber such as an acetate fiber, a triacetate fiber, etc.; a regenerated fiber such as a rayon fiber, a cupra fiber, etc.; a combination thereof and so on.

Specific examples of the polyamide (nylon) fiber include an aliphatic polyamide system fiber (polyamide 6, polyamide 66, etc.), an alicyclic polyamide system fiber, an aromatic polyamide system fiber, etc. Specific examples of the polyester fiber include a polyethylene terephthalate fiber, a polybutylene terephthalate fiber and so on. Specific examples of the polyolefin fiber include a polyethylene fiber, a polypropylene fiber and so on. A specific example of the acrylic fiber includes a fiber which comprises a copolymer of acrylonitrile and vinyl acetate or methyl acrylate and includes a polyacrylonitrile component of 85% or more, or the like. A specific example of the acrylic system fiber includes a fiber which comprises a copolymer of acrylonitrile and vinyl chloride and includes a polyacrylonitrile component in a range of 35 to 85%, or the like. From the viewpoints of a low heat shrinkability, texture feeling, tactile impression, toughness, washing durability, affinity for dyes, etc., the synthetic fiber yarn is preferable as the chemical fiber yarn, especially, the polyamide (nylon) fiber yarn and the polyester fiber yarn are more preferable.

Specific examples of a fiber for composing the natural fiber yarn include a plant fiber (cellulose polymer fiber) such as a cotton fiber, a hemp fiber and so on, an animal fiber (protein polymer fiber) such as a wool fiber, a silk fiber and so on. From the viewpoints of a low heat shrinkability, texture feeling, tactile impression, toughness, washing durability, affinity for dyes, etc., the plant fiber yarn is preferable as the natural fiber yarn, and the cotton yarn is more preferable. The cotton yarn may be a carded yarn or a combed yarn, and it can be selected from these yarns according to use.

It is preferable that the sheath yarn 11 particularly has a low heat shrinkability. The reason is that since an elastic woven fabric is generally heated in a manufacturing process such as a dyeing process after weaving, when a yarn having a large heat shrinkability is used as the sheath yarn 11, the elastic woven fabric shrinks due to shrinkage of the sheath yarn. The heat shrinkability of the sheath yarn 11 is preferably 30% or less based on a free-shrinkage percentage under a condition of a temperature of 180° C.×30 min.

From the viewpoints of a texture feeling, tactile impression, toughness, washing durability, etc., it is preferable that fineness of the sheath yarn 11 is generally in a range of 5 to 1,000 dtex. The fineness of the sheath yarn 11 is preferably in a range of 10 to 500 dtex in a case of the chemical fiber yarn, and in a range of 100 to 1,000 dtex in a case of the natural fiber yarn.

As the sheath yarn 11, either of a spun yarn and a filament yarn can be used according to a kind of fiber, use of the woven fabric and so on. When using the filament yarn, either of a monofilament yarn and a multifilament yarn may be used.

The sheath yarn 11 is preferably a twisted yarn. Although a twist number of the twisted yarn is not particularly limited, when assuming that the twist number is expressed as T (unit: twists/2.54 cm) and a cotton count is expressed as S (unit: yarn count), a sheath yarn 11 having a twist coefficient K in a range of 2 to 6 is preferably used from the viewpoints of a quality stability, productivity when producing the composite yarn, easy availability, etc., the twist coefficient K being expressed as an equation: $K=T/\sqrt{S}$.

As necessary, the sheath yarn 11 may be subjected to a dyeing processing with using indigo or other dye by a known dyeing method such as a rope dyeing method.

(3) Winding Form of Sheath Yarn

In order to obtain excellent elongation properties and elastic recovery properties, the elastic composite yarn 1 is formed as a singly-covered yarn in which the elastic core yarn 10 is covered by a single layer of the sheath yarn 11 helicoidally wound around a periphery of the elastic core yarn 10. The singly-covered yarn is more excellent in elongation properties and elastic recovery properties than a doubly-covered yarn in which the elastic core yarn 10 is covered by double layers of the sheath yarn 11 helicoidally wound around the periphery of the elastic core yarn 10. Therefore, using the singly-covered yarn makes it possible to obtain an elastic woven fabric having more excellent elongation properties and elongation recovery properties than using the doubly-covered yarn.

A preferable degree of coverage by the sheath yarn 11 on the elastic core yarn 10 is in a degree that the elastic core yarn 10 is thoroughly covered such that the core yarn 10 is not visually recognized after weaving. However, as long as an excellent elasticity of the elastic composite yarn 1 is secured, it is allowed that the core yarn 10 is somewhat exposed after weaving, according to use.

In order to obtain excellent elongation properties and elongation recovery properties of the elastic woven fabric, a number of turns of the sheath yarn 11 per 1 meter of the elastic core yarn is in a range of 1,000 to 2,500 T/m. When this number of turns is less than 1,000 T/m, the elongation properties and elongation recovery properties of the elastic woven fabric are insufficient. On the other hand, even when this number of turns is more than 2,500 T/m, the effects are saturated. This number of turns is preferably in a range of 1,300 to 2,400 T/m, more preferably 1,800 to 2,200 T/m.

(4) Elongation Rate and Elastic Recovery Rate of Elastic Composite Yarn

In order to obtain excellent elongation properties and elongation recovery properties of the elastic woven fabric, the elastic composite yarn 1 used in the present invention has an elongation rate of equal to or more than 30% and an elastic recovery rate of equal to or more than 70%. This elongation rate is preferably equal to or more than 50%, more preferably equal to or more than 60%. In order to prevent the toughness of the woven fabric from reducing, this elongation rate is preferably equal to or less than 120%, more preferably equal to or less than 110%. This elastic recovery rate is preferably in a range of 80 to 100%, more preferably 90 to 100%.

(B) Warp Yarn

As the warp yarns, it is possible to use the same as those for the above described sheath yarn 11. However, from the viewpoints of a texture feeling, tactile impression, toughness, washing durability, etc., fineness of the warp yarns is preferably in a range of 100 to 2,000 dtex, more preferably 300 to 900 dtex. Particularly, the warp yarns are preferably spun yarns of which a main component is a cellulosic staple fiber such as cotton fiber or the like and of which fineness is greater than 50 English cotton count (118 dtex). Particularly when forming a stretch chino cloth, two-ply combed yarns are used. As necessary, the warp yarn may be subjected to a dyeing processing with using indigo or other dye by a known dyeing method such as a rope dyeing method.

(C) Structure of Elastic Woven Fabric

A weave of the elastic woven fabric is not limited, and can be chosen according to use. When using as a stretch denim and a stretch chino cloth, a twill weave is chosen as the weave. Particularly when a stretch denim is produced, generally 2/1 twill weave, 3/1 twill weave, 2/2 twill weave, etc. are chosen. The twill weave may be any of right hand twill, left hand twill and broken twill, but is not limited to these.

(D) Physical Properties of Elastic Woven Fabric

The elastic woven fabric of the present invention is in a condition that a degree of the stretching of each of the elastic composite yarns is decreased. Specifically, a stretching magnification ratio of each of the elastic composite yarns in the elastic woven fabric in a weaving process is retained equal to or less than 1.30 folds based on the elastic composite yarn before weaving. Thus, a low washing shrinkage rate can be obtained in addition to excellent elongation properties and elongation recovery properties. This stretching magnification ratio is preferably equal to or less than 1.20 folds, more preferably equal to or less than 1.10 folds, still preferably equal to or less than 1.05 folds, most preferably equal to or less than 1.03 folds.

An elongation rate under a constant load (JIS-L-1096) in a weft direction of the elastic woven fabric is very high of 20% or more. This elongation rate under a constant load is preferably 30% or more, more preferably 50% or more. An elongation recovery rate (JIS-L-1096) in the weft direction of the elastic woven fabric is very high of 85% or more. This elongation recovery rate is preferably 90% or more.

As described above, since the elastic woven fabric of the present invention is in a condition that the degree of the stretching of each of the elastic composite yarns is decreased, the washing shrinkage rate in the weft direction is very low of 5% or less. This washing shrinkage rate is preferably 3% or less, more preferably 2% or less, most preferably 1% or less.

A yarn density of the elastic composite yarns after a washing treatment is in a range of 10 to 80 pieces/cm. Thus, it is possible to obtain excellent elongation properties and elongation recovery properties. The yarn density of the elastic composite yarns after the washing treatment is preferably in a range of 15 to 70 pieces/cm. When the weft yarns consist of the elastic composite yarns 1 only, the yarn density of the elastic composite yarns is equal to a weft yarn density.

Since the washing shrinkage rate of the elastic woven fabric of the present invention is low, a warp yarn density after the washing treatment is comparatively low in a range of 15 to 80 pieces/cm. The warp yarn density after the washing treatment is in a range of 20 to 40 pieces/cm in a preferred example, 20 to 35 pieces/cm in a more preferred example, 22 to 32 pieces/cm in a still more preferred example.

Since the elastic woven fabric of the present invention has the low washing shrinkage rate in addition to the excellent elongation properties and elongation recovery properties, it is in excellent in productivity (yield), sewing workability and product designability. Moreover, the elastic woven fabric of the present invention has a high air permeability when stretched due to the excellent elongation properties, and has a high durability against bleaching and washing because it is excellent in resistant to chlorine-based chemicals or the like.

Figure 2:
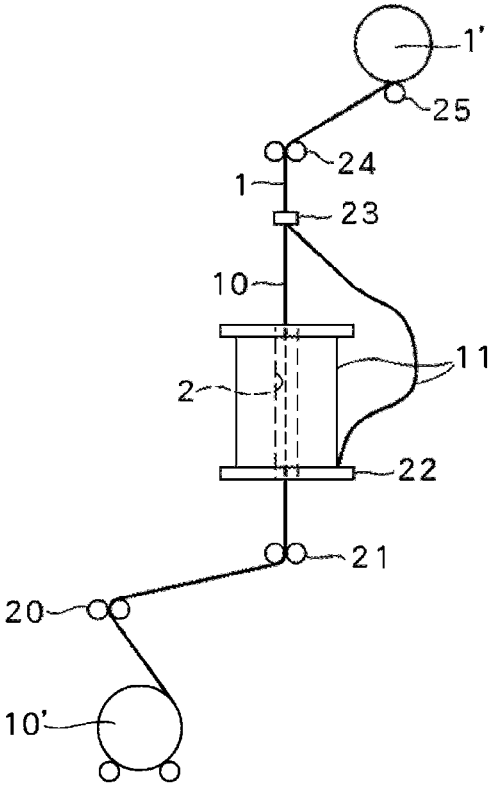
FIG. 2 is a schematic front elevational view showing an example of an apparatus for producing an elastic composite yarn.

[2] Method for Producing Elastic Woven Fabric (A) Producing of Elastic Composite Yarn The elastic composite yarn 1 is preferably produced by the hollow spindle method, though not limited to it. FIG. 2 is a schematic front elevational view showing an example of an apparatus for producing the elastic composite yarn 1 in a form of a singly-covered yarn by the hollow spindle method. An elastic yarn is drawn from an elastic yarn wound bobbin 10' for the core yarn 10, is guided to a hollow spindle 2 via a feed roller 20 and a yarn feed roller 21, and is used as the core yarn 10. The elastic yarn is preferably drafted between the feed roller 20 and the yarn feed roller 21 with a feed magnification factor of 0.8 to 1.3. This feed magnification factor is more preferably about 1.

The feed magnification factor is expressed by a ratio (V2/V1) of a yarn take-up rate (V2) to a yarn feed rate (V1). When the feed magnification factor is 1, it means that the yarn feed rate is equal to the yarn take-up rate. When the feed magnification factor is 1.3, it means that the ratio (V2/V1) is 1.3. When the feed magnification factor is less than 1, the yarn feed rate is larger than the yarn take-up rate, the yarn is fed in a so-called overfeeding condition, and thus the yarn is loosened between a delivery roller and a take-up roller. Feeding the yarn in an overfeeding condition is usually used when taking twist shrinkage in a twisting yarn process and when false twisting process is conducted. Generally, it is conducted with an overfeeding ratio of 5% or less.

In the present invention, the composite yarn 1 can be produced with a very small feed magnification factor of 0.8. When the elastic yarn is the polyurethane elastic yarn having high elasticity and the polyurethane elastic yarn is wound in a stretched state in a shipping form, for example, in a cheese winding form, the elastic yarn can be subjected to a usual process without loosening, because the elastic yarn is about to recover its original length even if the feed magnification factor is a large overfeeding value such as 0.8. When a non-elastic yarn is subjected to a process with a feed magnification factor of 0.8, it cannot be treated well owing to loosening.

In the twist yarn industry and the false-twist-texturing industry, when a yarn is fed in an overfeeding condition, a minus sign (−) is sometimes attached to before a magnification factor to indicate a degree of overfeeding. In this case, it should be noted that the minus sign (−) does not indicate a minus numerical value but merely indicates a feed magnification factor of less than 1. For example, when it is presented as a magnification factor of −0.8, this numerical value does not indicate a minus numerical value but means a feed magnification factor of 0.8.

A covering bobbin 22 on which a yarn for the sheath yarn 11 is wound is fit on the hollow spindle 2. The elastic core yarn 10 guided to the hollow spindle 2 is covered a predetermined number of times by the sheath yarn 11 between the hollow spindle 2 and the balloon guide 23, then is guided via a delivery roller 24 and a take-up roller 25, and is wound by a composite yarn winding bobbin 1'.

The produced composite yarn 1 has a structure that the core yarn 10 is made of the elastic yarn and the periphery of the core yarn 10 is covered by the sheath yarn 11 such that the yarns 10, 11 are integrated. The elastic core yarn 10 and the sheath yarn 11 stretch and shrink together according to stretching and shrinking of the woven fabric, and therefore it is possible to obtain a woven fabric excellent in elasticity. Moreover, the woven fabric of the present invention does not shrink after weaving.

The composite yarn 1 is an important factor in order to prevent shrunk of the woven fabric. The elastic core yarn 10 is preferably in a near state of its original length as much as possible. Therefore, the feed magnification factor of the elastic yarn is set in a range of 0.8 to 1.3 in the present invention. When the feed magnification factor is 0.8, it seems that the elastic yarn is fed in loosened state. Actually, as described above, since the elastic yarn is about to recover its original length from a stretched state, the elastic yarn is not loosened. It is a unique operation dependent on the properties of the elastic yarn in the present invention. It is usual that the polyurethane elastic yarn which is a representative example of a commercially available elastic yarn is supplied in a cheese winding form. Since the polyurethane elastic yarn is wound in a slightly stretched state owing to a tensile force applied during cheese winding, the polyurethane elastic yarn is subjected to overfeeding in order to recover its original length before being formed into a cheese winding. The degree of the feed magnification factor is estimated as 0.8. Therefore, when the feed magnification factor is 1, it means that the polyurethane elastic yarn is fed with a length in the same as that in a cheese winding state.

When the feed magnification factor is more than 1.3, the elastic yarn is fed in a stretched state. Therefore, it is unpreferable because a force making the elastic yarn shrink is large after weaving such that a width of the woven fabric is reduced. Since the sheath yarn 11 helicoidally covers the periphery of the core yarn 10 made of the elastic yarn, its length is larger than that of the elastic yarn and is sufficiently large to satisfy a necessary length to follow the elastic change of the woven fabric.

The number of turns of the sheath yarn 11 per 1 meter of the elastic core yarn per 1 is as described above. When a colored yarn is wished, the composite yarn 1 can be produced by covering the periphery of the core yarn 10 with the sheath yarn 11 previously dyed.

(B) Weaving Process

Figure 3:
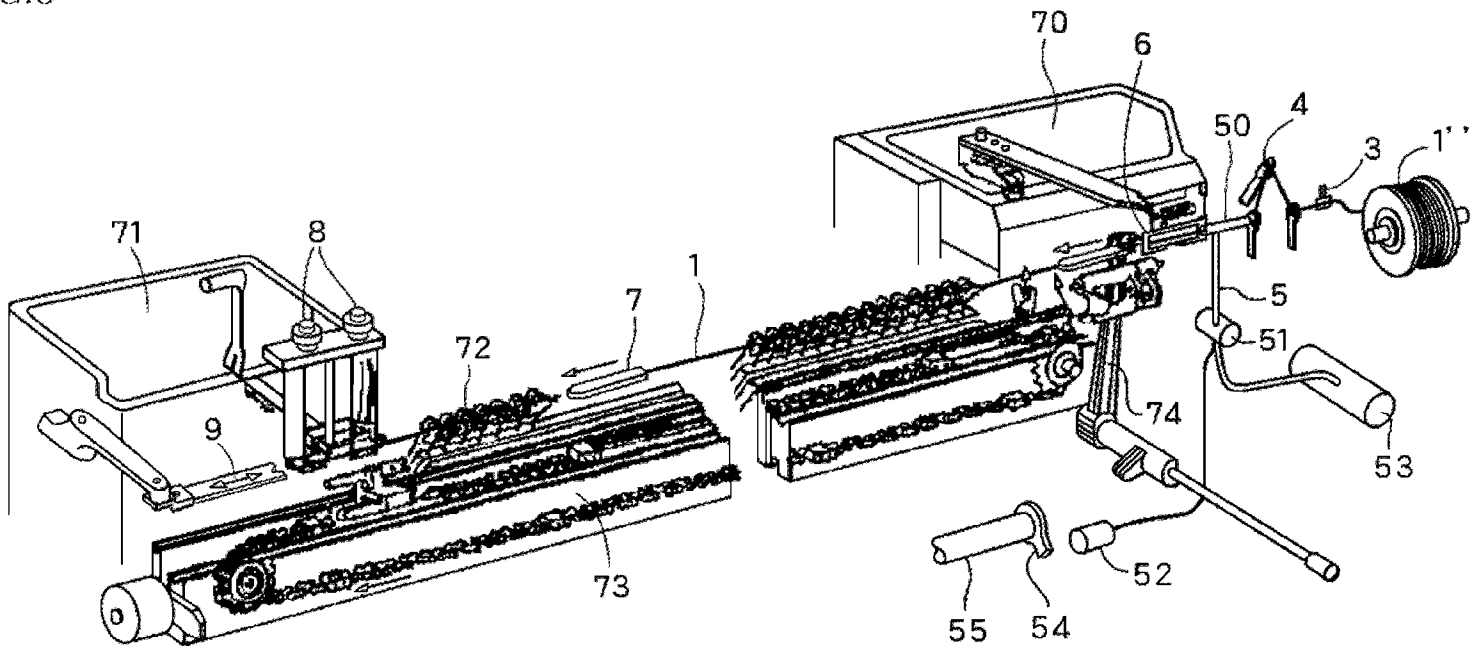
FIG. 3 is a schematic perspective view showing an example of a loom for producing an elastic woven fabric of the present invention.
Figure 4:
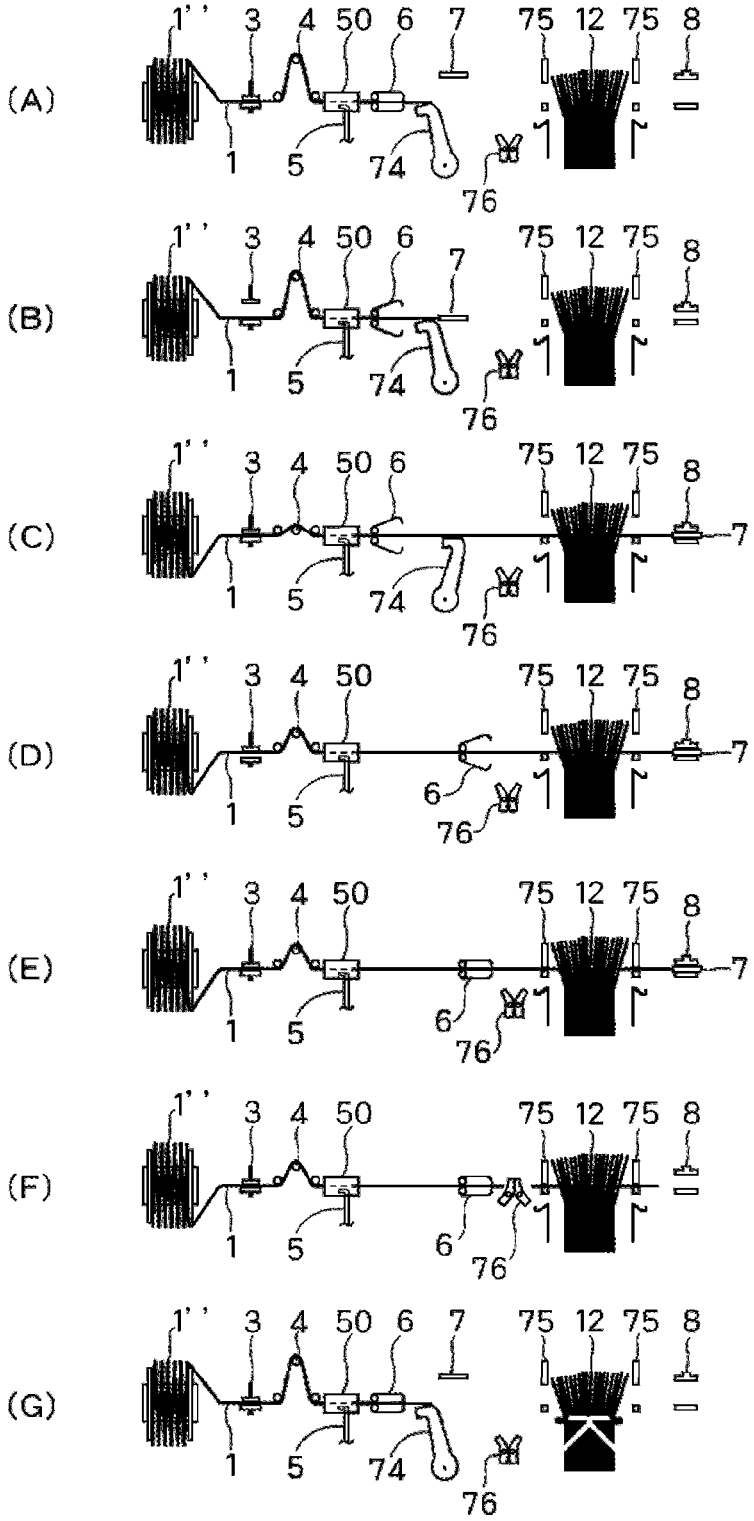
FIG. 4 is a schematic process explanatory view showing a weaving process by the loom shown in FIG. 3.

The elastic woven fabric of the present invention can be produced by a method using a gripper type loom described below (it is referred to as "gripper loom" below), though not limited to it. FIG. 3 is a schematic perspective view showing an example of a gripper loom for producing the elastic woven fabric of the present invention, and FIG. 4 is a schematic process explanatory view showing weaving steps A to G by this loom. The weft yarn (elastic composite yarn) 1 drawn from the yarn feeding cheese 1" is guided through an air blowing tube 50 via a weft yarn brake 3 and a weft tensioner 4 to a projectile feeder 6 provided to a picking unit 70, and is passed to a projectile 7 (steps A to B). The projectile 7 holding the weft yarn 1 is flicked by a torsion bar 74 so as to fly through a warp shedding in a weft direction along a number of guide sheaths 72, is held by a stopping brake 8 provided in a receiving unit 71 to be stopped, and is pushed back to a fixed position by a projectile returner 9 (steps C to D). The weft yarn 1 is held by a pair of weft end grippers 75, 75 at both ends of a fabric 12, and cut off from the projectile 7 by scissors 76 (steps E to F). Next, the projectile 7 is pushed out on a conveyor 73, and is returned to the side of the picking unit 70 through outside of the warp shedding by the conveyor 73.

Figure 5:
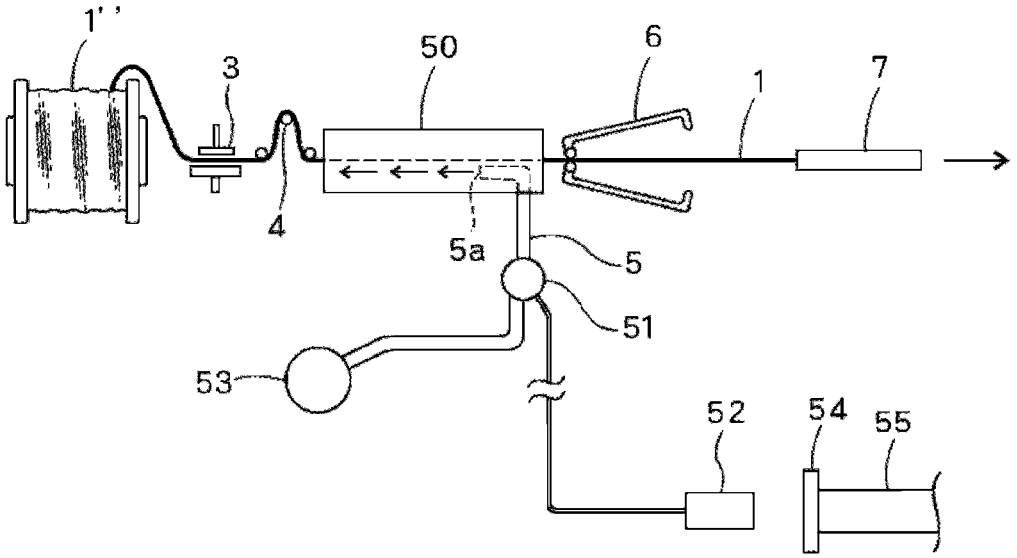
FIG. 5 is a schematic partial, enlarged front view showing an air nozzle and its vicinity of the loom shown in FIG. 3.

As shown in FIG. 5, the loom of the present invention is provided with the air blowing tube 50 between the weft tensioner 4 and the projectile feeder 6, and an air nozzle is inserted into the air blowing tube 50 as an air blowing means 5. A nozzle orifice 5*a* of the air nozzle 5 is oriented in a direction substantially opposite to a feed direction of the weft yarn 1 in the tube 50 such that air can be blown to the weft yarn 1. The air nozzle 5 is connected with an air compressor 53, and blowing and stopping of the air from the nozzle orifice 5*a* can be switched by opening and closing of a solenoid valve 51 provided between the air nozzle 5 and the air compressor 53. The solenoid valve 51 is switched between opening and closing by an operating proximity switch 52, and the operating proximity switch 52 is turned on in a predetermined rotation angle range of a main shaft 55 of the loom by a breaker plate 54 that is arranged in front of the operating proximity switch 52 and is connected with the main shaft 55 of the loom. During the steps C to G shown in FIG. 4, the air is continuously blown to the weft yarn 1 in the direction substantially opposite to the feed direction of the weft yarn 1.

Each of the steps A to G shown in FIG. 4 is explained in detail further below. In the step A, the projectile 7 returned by the conveyor 73 is set at a picking position. In the step B, the weft yarn 1 is passed to the projectile 7 by the projectile feeder 6, and the projectile feeder 6 is stopped in a state that its mouth is open. In the step C, the air is continuously blown to the weft yarn 1 in the direction substantially opposite to the feed direction of the weft yarn 1 in the air blowing tube 50 by the air nozzle 5 from just before flying or just start of flying of the projectile 7, and the weft yarn brake 3 and the weft tensioner 4 function so as to minimize a load on the weft yarn 1 when picking during the flying of the projectile 7. In the step D, in a state that the air is blown to the weft yarn 1 continuously, the projectile 7 is held by the stopping brake 8 at the receiving unit 71 to be stopped, and is pushed back to the fixed position by the projectile returner 9. During the same step, the weft yarn 1 is held in a lightly tensioned state by the weft tensioner 4, and the projectile feeder 6 is moved closer to the fabric 12. In order to prevent the weft yarn 1 from inertially getting into the warp yarns after the projectile 7 arrives at the receiving unit 71, a tensile force applied to the weft yarn 1 by the weft yarn brake 3 and the weft tensioner 4 is made strongest just before the projectile 7 is stopped by the stopping brake 8. At that moment, since the air has been blown to the weft yarn 1 in the direction substantially opposite to the feed direction of the weft yarn 1 in the present invention, it is possible to reduce the above strongest tensile force applied to the weft yarn 1 by the weft yarn brake 3 and the weft tensioner 4. Thus, it is possible to decrease a degree of the stretching of the weft yarn (elastic composite yarn) 1 in a weaving process.

In the step E, in a state that the air is blown to the weft yarn 1, at the same time that the projectile feeder 6 holds the weft yarn 1, the pair of weft end grippers 75, 75 hold the weft yarn 1 at both ends of the fabric 12. In the step F, in a state that the air is blown to the weft yarn 1, the weft yarn 1 is cut by the scissors 76 in the picking unit side of the fabric 12 and is freed from the projectile 7 in the receiving unit side of the fabric 12, and the projectile 7 is pushed out on the conveyor 73 and is returned to the side of the picking unit 70. After beating, in the step G, in a state that the air is blown to the weft yarn 1, the projectile feeder 6 goes back, and the resultant loosening of the weft yarn 1 is drawn by the weft tensioner 4 and is reduced by the blowing air. Then, it is returned to the step A in which the air blowing to the weft yarn 1 is stopped.

Since a conventional gripper loom is not provided with the air blowing means 5, it is necessary to operate the weft yarn brake 3 sharply and strongly during flying of the projectile 7 in order to prevent the weft yarn 1 from inertially getting into the warp yarns after the projectile 7 arrives at the receiving unit 71. On that account, there has been a problem that a large tension is applied to the weft yarn 1 and thus the weft yarn (elastic composite yarn) 1 is highly stretched. When the weft yarn (elastic composite yarn) 1 is highly stretched in the weaving process, there are problems that a woven fabric has a high shrinkage rate and deforms when freed from a loom, and that yield is low. When a woven fabric deforms, sewing workability is lowered and product designability is impaired.

The gripper loom of the present invention is provided with the air blowing means 5 in a vicinity of the weft yarn brake 3, and the air is blown to the weft yarn 1 in the direction substantially opposite to the feed direction of the weft yarn 1 during flying of the projectile 7. Therefore, even if the strongest tensile force applied to the weft yarn 1 by the weft yarn brake 3 and the weft tensioner 4 just before the projectile 7 is stopped by the stopping brake 8 is made weaker, particularly, even if the strongest braking force by the weft yarn brake 3 is made weaker, it is possible to prevent the weft yarn 1 from inertially getting into the warp yarns after the projectile 7 arrives at the receiving unit 71, and loosening of the weft yarn 1 is not generated in the warp yarns. Since the braking force by the weft yarn brake 3 is reduced, the tension applied to the weft yarn 1 is lowered, and it is possible to decrease the stretching of the weft yarn (elastic composite yarn) 1 in the weaving process.

As described above, the significance of blowing air to the weft yarn 1 in the direction substantially opposite to the feed direction of the weft yarn 1 is to reduce the tensile force applied by the weft yarn brake 3 and the weft tensioner 4 during picking in the step C, and is to reduce the strongest tensile force applied to the weft yarn 1 by the weft yarn brake 3 and the weft tensioner 4 just before the projectile 7 is stopped by the stopping brake 8 in the steps C to D, particularly, to reduce the strongest braking force by the weft yarn brake 3. Moreover, the significance of such blowing air is to prevent the weft yarn 1 from loosening in the warp yarns in the process of pushing back the projectile 7 by the projectile returner 9 in the step D and in the process of holding the weft yarn 1 by the pair of weft end grippers 75, 75 at both ends of a fabric 12 in the step E, and is also to prevent the weft yarn 1 from loosening in the process of cutting the weft yarn 1 in the step F and in the process of making the projectile feeder 6 go back in the step G.

The air nozzle is preferable as the air blowing means 5. However, when the air blowing means is possible to apply sufficient air pressure to the weft yarn 1, it is not restricted to the air nozzle 5 and it may be an air blower or the like. As shown in drawings, the air blowing means 5 is preferably arranged between the weft tensioner 4 and the projectile feeder 6. However, the position of the air blowing means 5 is not restricted as long as it is in a vicinity of the weft yarn brake 3.

In the present invention, it is preferable to regulate a discharge pressure of a compressed air flow blown to the elastic composite yarn 1 by using the air blowing means 5 and the tensile force applied to the elastic composite yarn 1 by the weft yarn brake 3 and the weft tensioner 4 in the steps C and D such that the stretching magnification ratio of the elastic composite yarn 1 in the elastic woven fabric in the weaving process is retained equal to or less than 1.30 folds based on the elastic composite yarn before weaving, preferably equal to or less than 1.20 folds, more preferably equal to or less than 1.10 folds, still preferably equal to or less than 1.05 folds, most preferably equal to or less than 1.03 folds. The "tensile force" mentioned here means the tensile force applied to the elastic composite yarn 1 by the weft yarn brake 3 and the weft tensioner 4 in the step C, and the strongest tensile force applied to the weft yarn 1 by the weft yarn brake 3 and the weft tensioner 4 just before the projectile 7 is stopped by the stopping brake 8 in the steps C to D, particularly, the strongest braking force applied by the weft yarn brake 3.

The discharge pressure of the compressed air flow blown by using the air blowing means 5, that is, the discharge pressure (gauge pressure) of the compressed air flow blown to the weft yarn 1 in the direction substantially opposite to the feed direction of the weft yarn 1 is generally equal to or more than 200 kPa. This discharge pressure is preferably equal to or more than 300 kPa, more preferably equal to or more than 350 kPa in order to sufficiently decrease the stretching of the elastic composite yarn 1 in the weaving process by sufficiently decreasing the tensile force, particularly, the strongest tensile force applied by the weft yarn brake 3 and the weft tensioner 4. An upper limit of this discharge pressure is preferably 600 kPa. Even if this discharge pressure is more than 600 kPa, the effect is saturated. The shortest distance from a center of the nozzle orifice 5*a* of the air nozzle 5 to the weft yarn 1 (distance in a radius direction in a cross section of the tube 50) is preferably equal to or less than 2 cm. Incidentally, a flying velocity of the projectile 7 may be such as 40 to 47 m/s that is a general velocity.

Figure 6:
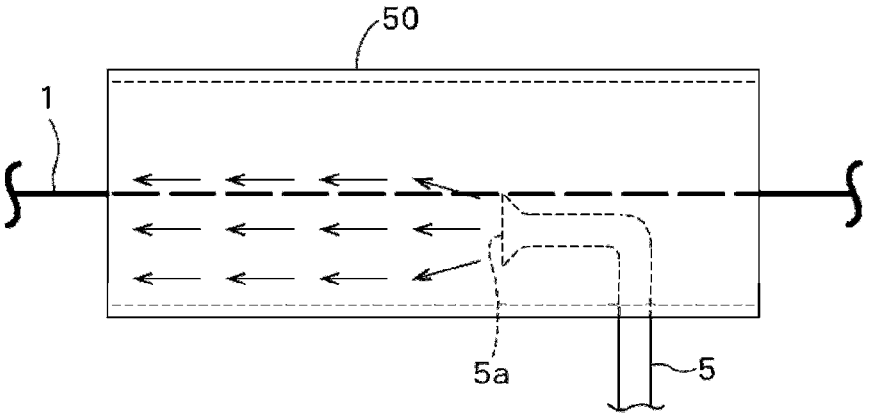
FIG. 6 is a schematic partial, enlarged front view showing another example of the air nozzle.
Figure 7A:
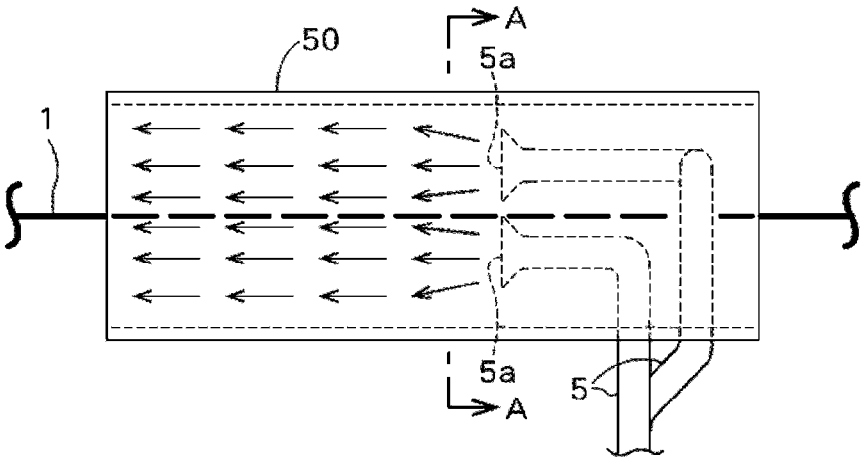
FIG. 7(*a*) is a schematic partial, enlarged front view showing still another example of the air nozzle, and FIG. 7(*b*) is a sectional view taken along the line A-A in FIG. 7(*a*).
Figure 7B:
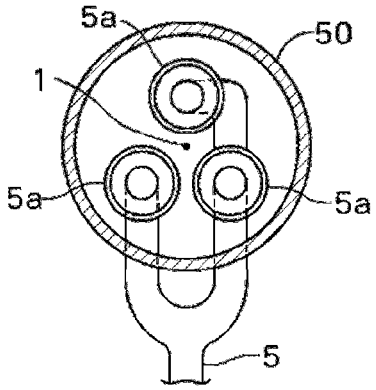

An inner diameter of the nozzle orifice 5*a* of the air nozzle 5 is preferably equal to or more than 3 mm, more preferably 3 to 5 mm so that the compressed air flow passes along a whole periphery of the weft yarn 1. As shown in FIG. 6, an end portion of the nozzle orifice 5*a* may be widened such that the compressed air flow diffuses to a degree for covering the whole periphery of the weft yarn 1. As shown in FIG. 7 (*a*), (*b*), a tip portion of the nozzle 5 may branch into a few nozzle orifices 5*a* arranged around the periphery of the weft yarn 1.

Although the air blowing tube 50 is not always indispensable, it is preferable to provide the air blowing tube 50 at an arrangement position of the air nozzle 5 so as to make a formation in which the tip portion of the air nozzle 5 is inserted into the air blowing tube 50 as exemplified in the drawings. By making the compressed air flow pass through the air blowing tube 50, it is possible to prevent useless diffusion of the compressed air flow so that the compressed air flow can be effectively made pass along the whole periphery of the weft yarn 1, and it is possible to effectively apply a pressure of the compressed air flow to the weft yarn 1.

The air blowing tube 50 is preferably in a cylindrical shape. In order to sufficiently obtain the effect as described above of the air blowing tube 50, regarding size of the cylindrical air blowing tube 50, an inner diameter at least at a portion into which the nozzle orifice 5*a* is inserted is preferably equal to or less than 5 cm, more preferably equal to or less than 3 cm, and a length is preferably equal to or more than 25 cm.

Figure 8:
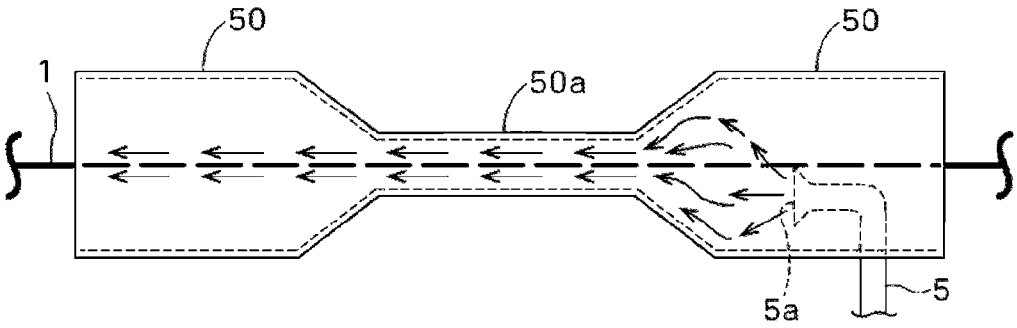
FIG. 8 is a schematic partial, enlarged front view showing still another example of the air nozzle.

As shown in FIG. 8, a flow path of the cylindrical air blowing tube 50 may be narrowed at the middle portion 50*a*. When the air blowing tube 50 is formed in such a shape, it is possible to raise a dynamic pressure of the compressed air flow passing through the middle portion 50*a* further, and to apply the pressure of the compressed air flow on the weft yarn 1 effectively further.

Figure 9:
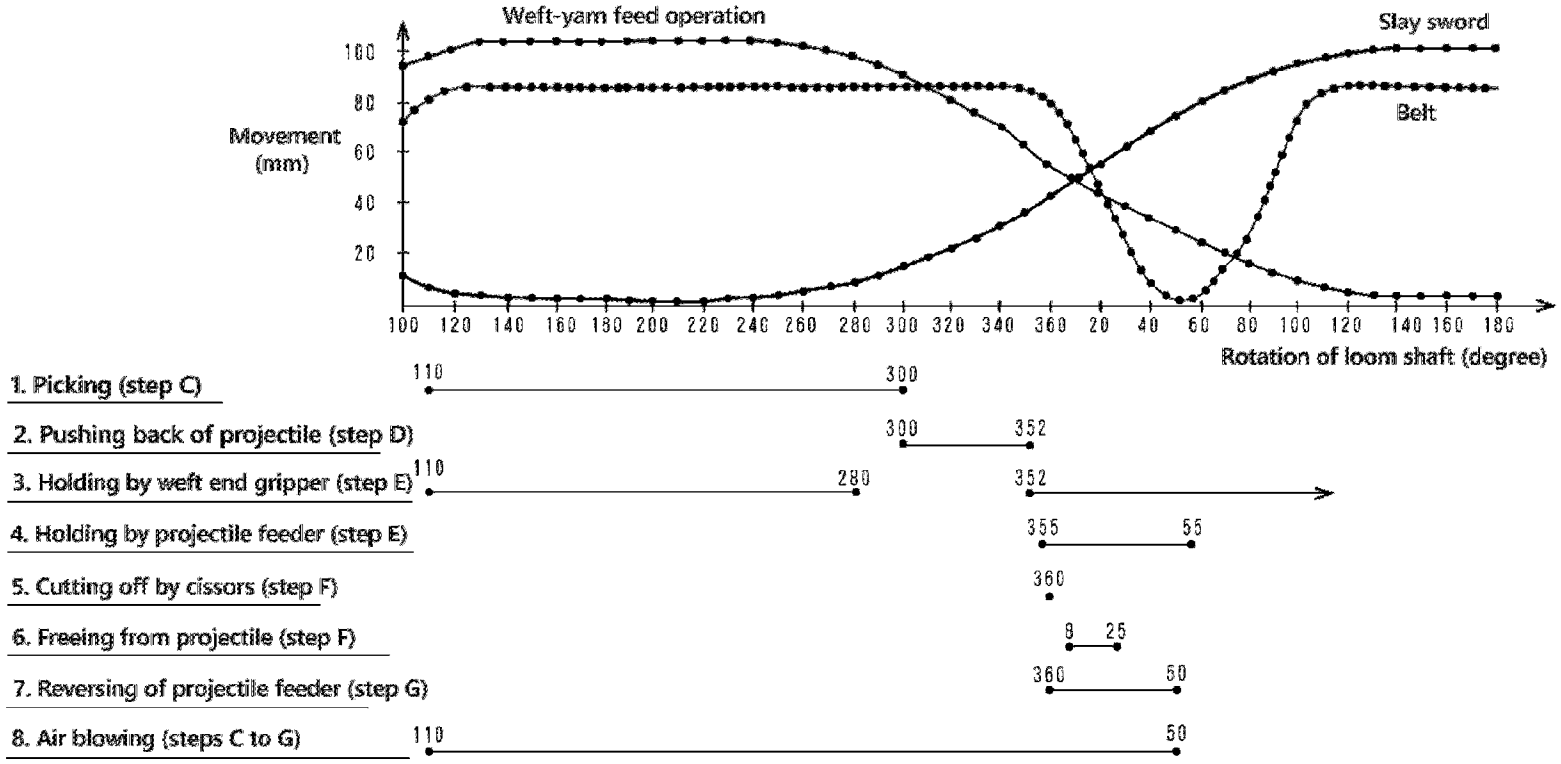
FIG. 9 is a flowchart showing an example of a relation between a rotation angle (degree) of a main shaft of a loom and each movement of a slay sword and a belt respectively actuated by the main shaft, and a relation between the rotation angle (degree) and a weft-yarn feed operation.

FIG. 9 is a flowchart showing an example of a relation between a rotation angle (degree) of the main shaft (loom shaft) 55 of the loom and each movement of a slay sword and a belt respectively actuated by the main shaft 55, and a relation between the rotation angle (degree) and a weft-yarn feed operation. In this example, the air is blown to the weft yarn 1 in the direction opposite to the feed direction of the weft yarn 1 in the following stages: the rotation angle of the main shaft 55 is in a range of 110 to 300 degrees between from feeding of the weft yarn 1 to arrival at the receiving side (the step C), the rotation angle is in a range of 300 to 352 degrees while the projectile 7 is pushed back to the fixed position by the projectile returner 9 (the step D), the rotation angle is at 352 degree when the weft end grippers 75, 75 start to hold the weft yarn 1 at both ends of the fabric 12 (the step E), the rotation angle is at 360 degree, that is, 0 degree when the weft yarn 1 is cut by the scissors 76 (the step F), and the rotation angle is in a range of 0 to 50 degrees while the projectile feeder 6 is returned (the step G). In other words, during the rotation angle of the main shaft 55 is in a range of 110 to 50 degrees via 360 degrees (0 degree), the operating proximity switch 52 is turned on, the solenoid valve 51 is operated, and the air from the compressor 53 is ejected through the nozzle orifice 5*a*.

As necessary, the elastic woven fabric obtained by the above described steps can be subjected to known processing such as refining (desizing, removal of impurities and so on), bleaching, dyeing, aqueous washing, heat setting, mercerization, etc.

According to the producing method described above, the stretching magnification ratio of each of the elastic composite yarns 1 in the elastic woven fabric in the weaving process can be retained equal to or less than 1.30 folds based on the elastic composite yarn before weaving. This stretching magnification ratio is preferably equal to or less than 1.20 folds, more preferably equal to or less than 1.10 folds, still preferably equal to or less than 1.05 folds, most preferably equal to or less than 1.03 folds.

[3] Use of Elastic Woven Fabric

Since the elastic woven fabric of the present invention has the low washing shrinkage rate in addition to the excellent elongation properties and elongation recovery properties, it is in excellent in productivity, sewing workability and product designability. Moreover, it is excellent in resistant to chlorine-based chemicals or the like. Therefore, the elastic woven fabric of the present invention is useful as an elastic clothing material used for an elastic clothing such as stretch jeans, stretch chino pants, a sport wear, a supporter, stockings, etc. Particularly, the elastic woven fabric of the present invention is useful as the stretch denim used for stretch jeans, and is useful as the stretch chino cloth used for stretch chino pants. The stretch denim may be not only a stretch indigo denim but also a stretch color denim for which a dye other than indigo is used. The stretch chino cloth may be not only a traditional one for which a khaki or beige dye is used but also a stretch color chino cloth for which a dye other than such a dye is used. Moreover, the elastic woven fabric of the present invention can be used for a material for a supporter, particularly for a medical supporter by taking advantage of the high air permeability when stretched.

The present invention will be explained in more detail referring to Examples below without intention of restricting the scope of the present invention.

Example 1

(1) Preparation of Elastic Composite Yarn

With using the apparatus shown in FIG. 2, an elastic composite yarn was prepared by the hollow spindle method. A bobbin wound with a polyurethane elastic yarn having fineness of 395 dtex (available from Toray Industries, Inc.) for a core yarn was set on a bobbin stand for core yarn of a covering machine table, and a feed magnification factor of the core yarn was set as 1. This core yarn was guided at a yarn speed of 3.8 m/minute to one hollow spindle into which a bobbin wound with a nylon yarn having fineness of 22 dtex (available from Toray Industries, Inc.) for a sheath yarn was inserted. The core yarn was helicoidally covered by the sheath yarn such that a number of turns of the sheath yarn per 1 meter of the core yarn is 2,000 T/m, the obtained covered yarn was wound, and a singly-covered type composite yarn was obtained.

(2) Production of Elastic Woven Fabric

With using the gripper loom shown in FIG. 3, the elastic composite yarn prepared in the above described (1) was used for weft yarns, a cotton spun yarn having fineness of 591 dtex (available from KAIHARA Co., Ltd.) was used for warp yarns, and an elastic woven fabric having a 3/1 Right hand twill was produced. From just before flying of a projectile, during flying of the projectile, air with a discharge pressure (gauge pressure) of 400 kPa was blown to the weft yarn in an air blowing tube by an air nozzle in a direction substantially opposite to a feed direction of the weft yarn. The air blowing had been continued during the steps C to G shown in FIG. 4. The obtained gray fabric was freed from the gripper loom, was immersed in a warm water for desizing, was dried, and an elastic woven fabric was obtained.

Example 2

An elastic woven fabric was produced in the same manner as in Example 1, except that the cotton spun yarn having fineness of 295 dtex (available from KAIHARA Co., Ltd.) was used for the sheath yarn.

Example 3

An elastic woven fabric was produced in the same manner as in Example 1, except that a polyurethane elastic yarn having fineness of 78 dtex (available from Toray Industries, Inc.) was used for the elastic core yarn.

Example 4

An elastic woven fabric was produced in the same manner as in Example 1, except that a polyurethane elastic yarn having fineness of 1,240 dtex (available from Toray Industries, Inc.) was used for the elastic core yarn.

Example 5

An elastic woven fabric was produced in the same manner as in Example 1, except that the number of turns of the sheath yarn on the elastic core yarn was 1,500 T/m.

Example 6

An elastic woven fabric was produced in the same manner as in Example 1, except that the number of turns of the sheath yarn on the elastic core yarn was 2,300 T/m.

Example 7

An elastic woven fabric was produced in the same manner as in Example 1, except that a polyurethane elastic yarn having fineness of 620 dtex was used for the elastic core yarn, and that a yarn density of the elastic composite yarns after desizing and drying of the gray fabric was 17 pieces/cm.

Example 8

An elastic woven fabric was produced in the same manner as in Example 1, except that a polyurethane elastic yarn having fineness of 310 dtex was used for the elastic core yarn, and that the yarn density of the elastic composite yarns after desizing and drying of the gray fabric was 63 pieces/cm.

Comparative Example 1

An elastic woven fabric was produced in the same manner as in Example 1, except that when weaving, the air blowing by the air nozzle during flying of the projectile was not conducted.

Comparative Example 2

(1) Preparation of Composite Yarn

A doubly-covered type composite yarn was prepared by the hollow spindle method. A bobbin wound with the polyurethane elastic yarn having fineness of 395 dtex (available from Toray Industries, Inc.) for a core yarn was set on a bobbin stand for core yarn of a covering machine table, and a feed magnification factor of the core yarn was set as 1. This core yarn was guided at a yarn speed of 3.8 m/minute to a first hollow spindle into which a bobbin wound with the nylon yarn having fineness of 22 dtex (available from Toray Industries, Inc.) for a sheath yarn was inserted. The core yarn was helicoidally covered by the sheath yarn such that a number of turns of the sheath yarn per 1 meter of the core yarn is 1,500 T/m, was further guided to a second hollow spindle into which a bobbin wound with the same sheath yarn was inserted, was helicoidally covered by the sheath yarn such that a number of turns of the sheath yarn per 1 meter of the core yarn is 2,000 T/m, was wound, and a doubly-covered type composite yarn was obtained.

(2) Production of Elastic Woven Fabric

An elastic woven fabric was produced in the same manner as in Example 1, except that the doubly-covered type composite yarn prepared in the above described (1) was used for the weft yarns.

Comparative Example 3

An elastic woven fabric was produced in the same manner as in Example 1, except that a polyurethane elastic yarn having fineness of 17 dtex (available from Toray Industries, Inc.) was used for the elastic core yarn.

Comparative Example 4

An elastic woven fabric was produced in the same manner as in Example 1, except that the number of turns of the sheath yarn on the elastic core yarn was 900 T/m.

Comparative Example 5

An elastic woven fabric was produced in the same manner as in Example 1, except that the yarn density of the elastic composite yarns after desizing and drying of the gray fabric was 10 pieces/cm.

The properties of the woven fabrics obtained in Examples 1 to 8 and Comparative Examples 1 to 5 were measured by the following methods. The results are shown in Table 1.

(1)

(1) Elongation Rate and Elastic Recovery Rate of Elastic Composite Yarn

A sample regulated in a stable condition regarding a dimensional change was set in a tensile testing machine with a sample length of $L_0$=100 mm while applied by an initial load of $1.764\times10^{-3}$ cN/dtex (2 mg/d) per unit fineness, and was elongated at a tension speed of 50 mm/minute. The elongating process was stopped when the load reached to $8.82\times10^{-2}$ cN/dtex (0.1 g/d) per unit fineness of the sample, and an elongation $L_1$ at that point is taken. The sample was kept in the elongated state for 1 minute, was returned to recover the original length at the same speed, was kept for 3 minutes, and was again elongated at the same speed. The elongating process was stopped when the load reached to a point in the same as the initial load, an elongation $L_2$ at that point is taken, and a longation rate (%) and an elastic recovery rate were respectively calculated according to the following equations.

$$\text{elongation rate (\%)}=(L_1/L_0)\times100$$

$$\text{elastic recovery rate (\%)}=[(L_1-L_2)/L_1]\times100$$

Each of the samples was measured 10 times, and an average value was calculated.

(2) Stretching Magnification Ratio of Elastic Composite Yarns in Elastic Woven Fabric in Weaving Process When the woven fabric having a length of 5 m was produced from beginning of weaving, a consumption mass of the elastic composite yarn (mass (g) of the weft yarn 1 drawn from the yarn feeding cheese 1" in FIG. 3) was measured, and the obtained consumption mass was converted into a consumption length La (meter) of the elastic composite yarn in a case that the woven fabric having the same length was produced based on fineness (dtex) of the elastic composite yarn. Moreover, a number of weft insertion N (number of times) was measured in the case that the woven fabric having the same length was produced. Assuming that a flying length of the weft yarn [weaving width (reeding width)+selvage widths (meter)] of the loom is Lb, a stretching magnification ratio Esf (folds) of each of the elastic composite yarns in the elastic woven fabric in the weaving process was averagely calculated according to the following equation.

$$Esf(\text{folds})=(Lb\times N)/La$$

At this point, the above described "selvages" are respectively provided at both sides of the weaving width portion (reeding width portion). Generally, each time when one weft yarn is inserted into the warp shedding, the warp shedding is closed in a state that the selvages are held, and the weft yarn is beaten by a reed. Generally, the weft yarn is configured by a base unit consisting of the weaving width portion (reeding width portion) and the selvages provided at both sides of the weaving width portion (reeding width portion).

(3) Washing Shrinkage Rate

A sample was subjected to a washing treatment according to Section 8.39.5 (dimensional change) in JIS-L-1096 (Testing methods for woven and knitted fabrics), and then a weft yarn density and a warp yarn density were measured. A test fabric having a size of 60 cm×60 cm in warp and weft directions was collected from a sample of which a dimension was sufficiently stabilized, and three pairs of marks spaced apart at 500 mm were put in both warp and weft directions. At first, according to the F-2 method (medium temperature washer method in Article 2.2.2) in Subsection b) in Section 8.39.5 in JIS-L-1096, a warm water (about a temperature of 60° C.) having sufficient quantity (about 60 L) for covering specimens of the test fabric was put into a washing machine, the specimens of the test fabric of 1.4 kg were put into the warm water, simultaneously, additive-free powder laundry soap according to JIS-K-3303 (Type 1) was put into the hot water to prepare a solution of about 0.1%, and the washing machine was run for 30 minutes. Next, the washing machine was run for 5 minutes after the warm water was exchanged to new one of about a temperature of 40° C., and was run for 10 minutes after the warm water was again exchanged to new one of about a temperature of 40° C. After draining, the specimens were taken out, were put into a tumble dryer, and were dried for 40 minutes at a temperature of 60° C. Then, heating was stopped, the specimens were cooled by rotating the tumble dryer for about 5 minutes, and were taken out immediately after the tumble dryer was stopped. The specimens were unfolded at room temperature to be left for 1 hour, then each interval (cm) of the three pairs of marks in both warp and weft directions was measured, and each average value in the warp and weft directions was calculated.

(4) Elongation Rate Under Constant Load and Elongation Recovery Rate of Elastic Woven Fabric An elongation rate under a constant load and an elongation recovery rate of the elastic woven fabric after the above described washing treatment were measured according to the B method (Test Methods under Constant Load for Woven Fabric) in Section 8.16.1 "Elongation Rate" and the B-1 method (Test Methods under Constant Load) in Section 8.16.2 "Elongation Recovery Rate and Residual Strain Ratio" in JIS-L-1096.

[Elongation Rate Under Constant Load (Weft Direction)]

Three specimens having a size of 60 mm×300 mm in warp and weft directions were collected from a sample of which a dimension was stabilized. By using the tensile testing machine, each of the specimens was fixed by an upper clamp at an upper end portion, was put marks spaced apart at 250 mm while applying a load of 5% of a mass per unit area ($g/m^2$) as an initial load, and was calmly applied with a load of 14.7 N (1.5 kgf) from an unloaded state at a lower end portion. A length (mm) between the marks after left for 1 minute was measured, an elongation rate under a constant load (%) was calculated according to the equation below and an average value of three tests of the elongation rate was calculated.

$$E_P=[(L_1'-L_0')/L_0']\times 100$$

At this point, $E_P$ represents an elongation rate under a constant load (%), $L_0'$ represents a length (250 mm) between the marks in the initial state, and $L_1'$ represents a length (mm) between the marks after left for 1 minute under applying the load of 14.7N.

[Elongation Recovery Rate (Weft Direction)]

The load of 14.7 N was applied and the length (mm) between the marks after left for 1 hour was measured in the same manner as in the measurement of the elongation rate under the constant load, except that the specimens applied with the load were left for 1 hour. Next, the load was removed, the initial load of 5% of a mass per unit area ($g/m^2$) was applied after 30 seconds and 1 hour, the length (mm) between the marks was again measured, and the elongation recovery rate (%) was calculated according to the equation below and an average value of three tests of the elongation recovery rate was calculated.

$$Er=[(L_2'-L_3')/(L_2'-L_0')]\times 100$$

At this point, Er: elongation recovery rate (%), $L_0'$ represents a length (250 mm) between the marks in the initial state, $L_2'$ represents a length (mm) between the marks after left for 1 hour under applying the load of 14.7N, and $L_3'$ represents a length (mm) between the marks when the initial load was applied after 30 seconds and 1 hour from removing of the load.

(5) Yarn Density of the Elastic Composite Yarns and Warp Yarn Density

The yarn density of the elastic composite yarns and the warp yarn density of the elastic woven fabric before and after the above described washing treatment were respectively measured by a density automatic measuring instrument for woven and knitted fabrics.

(6) Tensile Strength and Tear Strength

A tensile strength and a tear strength of the elastic woven fabric before and after the above described washing treatment were respectively measured according to Section 8.14 (Tensile Strength and Elongation Rate) and Section 8.17 (Tear Strength) in JIS-L-1096 (Testing methods for woven and knitted fabrics).

TABLE 1

| | Example No. | | |
|---|---|---|---|
| | Example 1 | Example 2 | Example 3 |
| Weft Yarn: Elastic Composite Yarn | | | |
| Core yarn | PU Elastic Yarn(1) | PU Elastic Yarn | PU Elastic Yarn |
| Fineness (dtex) | 395 | 395 | 78 |
| Sheath Yarn | Nylon Yarn | Cotton Spun Yarn | Nylon Yarn |
| Fineness (dtex) | 22 | 295 | 22 |
| Feed Magnification Factor of Core Yarn (folds) | 1 | 1 | 1 |
| Winding Form of Sheath Yarn | Single(2) | Single | Single |

TABLE 1-continued

| | | | |
|---|---|---|---|
| Number of Turns (T/m) in First Stage | 2,000 | 1,550 | 2,000 |
| Number of Turns (T/m) in Second Stage | — | — | — |
| Elongation Rate of Composite Yarn (%) | 80 | 81 | 65 |
| Elastic Recovery Rate of Composite Yarn (%) | 95 | 96 | 92 |
| Warp Yarn | | | |
| Kind of Yarn | Cotton Spun Yarn | Cotton Spun Yarn | Cotton Spun Yarn |
| Fineness (dtex) | 591 | 591 | 591 |
| Production Condition by Gripper Loom | | | |
| Pressure of Compressed Air Flow (kPa) | 400 | 400 | 400 |
| Physical Properties of Elastic Woven Fabric | | | |
| Stretching Magnification Ratio of Composite Yarn in Weaving Process (folds) | 1.03 | 1.02 | 1.01 |
| Weave | 3/1Right Hand Twill | 3/1Right Hand Twill | 3/1Right Hand Twill |
| Before Washing Treatment | | | |
| Yarn Density of Composite Yarns (pieces/cm) | 55 | 18 | 55 |
| Warp Yarn Density (pieces/cm) | 29.5 | 29.5 | 29.5 |
| Tensile Strength | | | |
| Weft Direction (N) | 22.9 | 20.9 | 17.5 |
| Warp Direction (N) | 68 | 72 | 70 |
| Tear Strength | | | |
| Weft Direction (N) | 1,960 | 1,540 | 1,551 |
| Warp Direction (N) | 6,800 | 6,350 | 6,013 |
| After Washing Treatment | | | |
| Washing Shrinkage Rate | | | |
| Weft Direction (%) | 0.9 | 0.5 | 0.2 |
| Warp Direction (%) | 6.5 | 7.2 | 8.3 |
| Elongation Rate under Constant Load (%) | 71.9 | 88 | 69 |
| Elongation Recovery Rate | | | |
| 30 seconds (%) | 93.5 | 91.2 | 90.5 |
| 1 hour (%) | 95.5 | 95.2 | 93.5 |
| Yarn Density of Composite Yarns (pieces/cm) | 58.5 | 19.4 | 59.5 |
| Warp Yarn Density (pieces/cm) | 29.7 | 29.6 | 29.5 |
| Tensile Strength | | | |
| Weft Direction (N) | 23.7 | 22.7 | 18.1 |
| Warp Direction (N) | 60.1 | 65.5 | 53.2 |
| Tear Strength | | | |
| Weft Direction (N) | 3,220 | 2,880 | 3,005 |
| Warp Direction (N) | 6,750 | 6,637 | 6,545 |

| | Example No. | | |
|---|---|---|---|
| | Example 4 | Example 5 | Example 6 |
| Weft Yarn: Elastic Composite Yarn | | | |
| Core yarn | PU Elastic Yarn | PU Elastic Yarn | PU Elastic Yarn |
| Fineness (dtex) | 1,240 | 395 | 395 |
| Sheath Yarn | Nylon Yarn | Nylon Yarn | Nylon Yarn |
| Fineness (dtex) | 22 | 22 | 22 |
| Feed Magnification Factor of Core Yarn (folds) | 1 | 1 | 1 |
| Winding Form of Sheath Yarn | Single | Single | Single |
| Number of Turns (T/m) in First Stage | 2,000 | 1,500 | 2,300 |
| Number of Turns (T/m) in Second Stage | — | — | — |
| Elongation Rate of Composite Yarn (%) | 97 | 62 | 99 |
| Elastic Recovery Rate of Composite Yarn (%) | 98 | 91 | 98 |
| Warp Yarn | | | |
| Kind of Yarn | Cotton Spun Yarn | Cotton Spun Yarn | Cotton Spun Yarn |
| Fineness (dtex) | 591 | 591 | 591 |
| Production Condition by Gripper Loom | | | |
| Pressure of Compressed Air Flow (kPa) | 400 | 400 | 400 |
| Physical Properties of Elastic Woven Fabric | | | |
| Stretching Magnification Ratio of Composite Yarn in Weaving Process (folds) | 1.03 | 1.03 | 1.02 |
| Weave | 3/1Right Hand Twill | 3/1Right Hand Twill | 3/1Right Hand Twill |

TABLE 1-continued

| | | | |
|---|---|---|---|
| Before Washing Treatment | | | |
| Yarn Density of Composite Yarns (pieces/cm) | 13.5 | 55 | 55 |
| Warp Yarn Density (pieces/cm) | 29.5 | 29.5 | 29.5 |
| Tensile Strength | | | |
| Weft Direction (N) | 35.5 | 36.1 | 22.9 |
| Warp Direction (N) | 66 | 63 | 68 |
| Tear Strength | | | |
| Weft Direction (N) | 2,333 | 1,931 | 1,969 |
| Warp Direction (N) | 6,634 | 6,621 | 6,788 |
| After Washing Treatment | | | |
| Washing Shrinkage Rate | | | |
| Weft Direction (%) | 1.2 | 0.9 | 0.7 |
| Warp Direction (%) | 2.1 | 5.8 | 6.3 |
| Elongation Rate under Constant Load (%) | 89 | 66.9 | 89 |
| Elongation Recovery Rate | | | |
| 30 seconds (%) | 96.2 | 90.1 | 95.5 |
| 1 hour (%) | 97.1 | 92.1 | 97.8 |
| Yarn Density of Composite Yarns (pieces/cm) | 15.0 | 58.1 | 58.4 |
| Warp Yarn Density (pieces/cm) | 29.8 | 29.7 | 29.7 |
| Tensile Strength | | | |
| Weft Direction (N) | 30.1 | 21.2 | 22.2 |
| Warp Direction (N) | 61.5 | 59.2 | 60.1 |
| Tear Strength | | | |
| Weft Direction (N) | 3,420 | 3,012 | 3,315 |
| Warp Direction (N) | 6,650 | 6,098 | 6,333 |

| | Example No. | | |
|---|---|---|---|
| | Example 7 | Example 8 | Com. Ex. 1 |
| Weft Yarn: Elastic Composite Yarn | | | |
| Core yarn | PU Elastic Yarn | PU Elastic Yarn | PU Elastic Yarn |
| Fineness (dtex) | 620 | 310 | 395 |
| Sheath Yarn | Nylon Yarn | Nylon Yarn | Nylon Yarn |
| Fineness (dtex) | 22 | 22 | 22 |
| Feed Magnification Factor of Core Yarn (folds) | 1 | 1 | 1 |
| Winding Form of Sheath Yarn | Single | Single | Single |
| Number of Turns (T/m) in First Stage | 2,000 | 2,000 | 2,000 |
| Number of Turns (T/m) in Second Stage | — | — | — |
| Elongation Rate of Composite Yarn (%) | 85 | 75 | 80 |
| Elastic Recovery Rate of Composite Yarn (%) | 97 | 94 | 95 |
| Warp Yarn | | | |
| Kind of Yarn | Cotton Spun Yarn | Cotton Spun Yarn | Cotton Spun Yarn |
| Fineness (dtex) | 591 | 591 | 591 |
| Production Condition by Gripper Loom | | | |
| Pressure of Compressed Air Flow (kPa) | 400 | 400 | — |
| Physical Properties of Elastic Woven Fabric | | | |
| Stretching Magnification Ratio of Composite Yarn in Weaving Process (folds) | 1.02 | 1.03 | 1.40 |
| Weave | 3/1Right Hand Twill | 3/1Right Hand Twill | 3/1Right Hand Twill |
| Before Washing Treatment | | | |
| Yarn Density of Composite Yarns (pieces/cm) | 17 | 63 | 55 |
| Warp Yarn Density (pieces/cm) | 29.5 | 29.5 | 29.5 |
| Tensile Strength | | | |
| Weft Direction (N) | 18.8 | 25.5 | 22.7 |
| Warp Direction (N) | 65 | 67 | 68 |
| Tear Strength | | | |
| Weft Direction (N) | 1,730 | 2,240 | 1,970 |
| Warp Direction (N) | 5,950 | 6,400 | 6,500 |
| After Washing Treatment | | | |
| Washing Shrinkage Rate | | | |
| Weft Direction (%) | 0.5 | 0.9 | 12.7 |
| Warp Direction (%) | 8.1 | 2.1 | 3.1 |
| Elongation Rate under Constant Load (%) | 47 | 65.8 | 60.1 |

TABLE 1-continued

| | | | |
|---|---|---|---|
| Elongation Recovery Rate | | | |
| 30 seconds (%) | 90.1 | 96.2 | 88.2 |
| 1 hour (%) | 92.2 | 98.2 | 90.1 |
| Yarn Density of Composite Yarns (pieces/cm) | 18.3 | 64.3 | 61.9 |
| Warp Yarn Density (pieces/cm) | 29.6 | 29.7 | 40.4 |
| Tensile Strength | | | |
| Weft Direction (N) | 18.5 | 26.3 | 23.9 |
| Warp Direction (N) | 67.1 | 68.2 | 69.1 |
| Tear Strength | | | |
| Weft Direction (N) | 1,811 | 2,540 | 2,211 |
| Warp Direction (N) | 6,137 | 6,510 | 6,750 |

| | Example No. | | |
|---|---|---|---|
| | Com. Ex. 2 | Com. Ex. 3 | Com. Ex. 4 |
| Weft Yarn: Elastic Composite Yarn | | | |
| Core yarn | PU Elastic Yarn | PU Elastic Yarn | PU Elastic Yarn |
| Fineness (dtex) | 395 | 17 | 395 |
| Sheath Yarn | Nylon Yarn | Nylon Yarn | Nylon Yarn |
| Fineness (dtex) | 22 | 22 | 22 |
| Feed Magnification Factor of Core Yarn (folds) | 1 | 1 | 1 |
| Winding Form of Sheath Yarn | Double(3) | Single | Single |
| Number of Turns (T/m) in First Stage | 1,500 | 2,500 | 900 |
| Number of Turns (T/m) in Second Stage | 2,000 | — | — |
| Elongation Rate of Composite Yarn (%) | 50 | 30 | 45 |
| Elastic Recovery Rate of Composite Yarn (%) | 95 | 56 | 72 |
| Warp Yarn | | | |
| Kind of Yarn | Cotton Spun Yarn | Cotton Spun Yarn | Cotton Spun Yarn |
| Fineness (dtex) | 591 | 591 | 591 |
| Production Condition by Gripper Loom | | | |
| Pressure of Compressed Air Flow (kPa) | 400 | 400 | 400 |
| Physical Properties of Elastic Woven Fabric | | | |
| Stretching Magnification Ratio of Composite Yarn in Weaving Process (folds) | 1.11 | 1.04 | 1.03 |
| Weave | 3/1Right Hand Twill | 3/1Right Hand Twill | 3/1Right Hand Twill |
| Before Washing Treatment | | | |
| Yarn Density of Composite Yarns (pieces/cm) | 55 | 55 | 55 |
| Warp Yarn Density (pieces/cm) | 29.5 | 29.5 | 29.5 |
| Tensile Strength | | | |
| Weft Direction (N) | 30.1 | 12.2 | 23.3 |
| Warp Direction (N) | 67 | 61 | 66 |
| Tear Strength | | | |
| Weft Direction (N) | 2,550 | 980 | 2,210 |
| Warp Direction (N) | 6,820 | 5,560 | 6,770 |
| After Washing Treatment | | | |
| Washing Shrinkage Rate | | | |
| Weft Direction (%) | 7.2 | 1.3 | 1.0 |
| Warp Direction (%) | 3.5 | 9.2 | 6.5 |
| Elongation Rate under Constant Load (%) | 25 | 49 | 54 |
| Elongation Recovery Rate | | | |
| 30 seconds (%) | 73.8 | 69.2 | 69.0 |
| 1 hour (%) | 80.5 | 71.3 | 75.3 |
| Yarn Density of Composite Yarns (pieces/cm) | 56.9 | 60.6 | 58.5 |
| Warp Yarn Density (pieces/cm) | 31.6 | 29.8 | 29.7 |
| Tensile Strength | | | |
| Weft Direction (N) | 31.1 | 13.5 | 24.0 |
| Warp Direction (N) | 69.5 | 62.2 | 63.3 |
| Tear Strength | | | |
| Weft Direction (N) | 2,870 | 997 | 2,570 |
| Warp Direction (N) | 6,950 | 5,656 | 6,850 |

TABLE 1-continued

| | Example No. Com. Ex. 5 |
|---|---|
| Weft Yarn: Elastic Composite Yarn | |
| Core yarn | PU Elastic Yarn |
| Fineness (dtex) | 395 |
| Sheath Yarn | Nylon Yarn |
| Fineness (dtex) | 22 |
| Feed Magnification Factor of Core Yarn (folds) | 1 |
| Winding Form of Sheath Yarn | Single |
| Number of Turns (T/m) in First Stage | 2,500 |
| Number of Turns (T/m) in Second Stage | — |
| Elongation Rate of Composite Yarn (%) | 80 |
| Elastic Recovery Rate of Composite Yarn (%) | 95 |
| Warp Yarn | |
| Kind of Yarn | Cotton Spun Yarn |
| Fineness (dtex) | 591 |
| Production Condition by Gripper Loom | |
| Pressure of Compressed Air Flow (kPa) | 400 |
| Physical Properties of Elastic Woven Fabric | |
| Stretching Magnification Ratio of Composite Yarn in Weaving Process (folds) | 1.03 |
| Weave | 3/1Right Hand Twill |
| Before Washing Treatment | |
| Yarn Density of Composite Yarns (pieces/cm) | 10 |
| Warp Yarn Density (pieces/cm) | 29.5 |
| Tensile Strength | |
| Weft Direction (N) | 10.9 |
| Warp Direction (N) | 67 |
| Tear Strength | |
| Weft Direction (N) | 780 |
| Warp Direction (N) | 6,654 |
| After Washing Treatment | |
| Washing Shrinkage Rate | |
| Weft Direction (%) | 0.5 |
| Warp Direction (%) | 10.1 |
| Elongation Rate under Constant Load (%) | 28.0 |
| Elongation Recovery Rate | |
| 30 seconds (%) | 57 |
| 1 hour (%) | 61 |
| Yarn Density of Composite Yarns (pieces/cm) | 10.1 |
| Warp Yarn Density (pieces/cm) | 29.6 |
| Tensile Strength | |
| Weft Direction (N) | 11.0 |
| Warp Direction (N) | 68.2 |
| Tear Strength | |
| Weft Direction (N) | 812 |
| Warp Direction (N) | 6,773 |

Notes:
(1)PU represents polyurethane.
(2)Singly-covered type
(3)Doubly-covered type It is clear from Table 1 that the woven fabrics of Examples 1 to 8 were respectively low in stretching magnification ratio of the composite yarn before washing treatment, thus had the low washing shrinkage rate, and had excellent elongation properties and elongation recovery properties, because each of the woven fabrics of Examples 1 to 8 was produced with the elastic composite yarn in the form of the singly-covered yarn that had the number of turns of the sheath yarn per 1 meter of the elastic core yarn in a range of 1,000 to 2,500 T/m, wherein the elastic composite yarn had the elongation rate of 30% or more and the elastic recovery rate of 70% or more, and was formed by blown with the compressed air flow in the direction substantially opposite to the feed direction of the elastic composite yarn when weaving at the gripper loom.

The woven fabric of Comparative Example 1 was in higher stretching magnification ratio of the composite yarn before washing treatment than those of the woven fabrics of Examples 1 to 8, and thus had high washing shrinkage rate in the weft direction and high warp yarn density after washing treatment, because the air blowing to the elastic composite yarn by the air nozzle during flying of the projectile was not conducted when weaving at the gripper loom. The woven fabric of Comparative Example 2 was poorer in elongation rate and elongation recovery rate than those of the woven fabrics of Examples 1 to 8, had high stretching magnification ratio of the composite yarn in the weaving process, and thus had high washing shrinkage rate, because the doubly-covered yarn in which the elastic core yarn is covered by double layers of the sheath yarn was used as the elastic composite yarn. The woven fabric of Comparative Example 3 was lower in elastic recovery rate of the composite yarn and was poorer in elongation recovery rate, tensile strength in the weft direction, and tear strength in the weft direction than those of the woven fabrics of Examples 1 to 8, because the elastic core yarn having small fineness was used. The woven fabric of Comparative Example 4 was lower in elastic recovery rate of the composite yarn and was poorer in elongation recovery rate and tensile strength in the weft direction than those of the woven fabrics of Examples 1 to 8, because the elastic composite yarn having the number of turns of the sheath yarn per 1 meter of the elastic core yarn less than 1,000 T/m was used. The woven fabric of Comparative Example 5 was poorer in elongation rate, elongation recovery rate, tensile strength in the weft direction, and tear strength in the weft direction than those of the woven fabrics of Examples 1 to 8, because the yarn density of the elastic composite yarns was less than 15 pieces/cm.

The elastic woven fabric of the present invention has not only excellent elongation properties and elongation recovery properties but also a low washing shrinkage rate, is also excellent in productivity, sewing workability and product designability, and is excellent in resistant to chlorine-based chemicals or the like. Therefore, the elastic woven fabric of the present invention is useful as an elastic clothing material used for elastic clothing such as stretch jeans, stretch chino pants, sport wear, supporter, stockings, etc. Particularly, the elastic woven fabric of the present invention is useful as stretch denim used for stretch jeans and stretch chino cloth used for stretch chino pants. The stretch denim may be not only a stretch indigo denim but also a stretch color denim for which a dye other than indigo is used. The stretch chino cloth may be not only a traditional one for which a khaki or beige dye is used but also a stretch color chino cloth for which a dye other than such a dye is used. Moreover, the elastic woven fabric of the present invention can be used for a material for a supporter, particularly for a medical supporter by taking advantage of the high air permeability when stretched.

What is claimed is:

1. An elastic woven fabric comprising weft and warp yarns, the weft yarns including a plurality of elastic composite yarns each of which comprises an elastic core yarn and a sheath yarn covering the elastic core yarn, and the warp yarns including a plurality of chemical fiber yarns and/or a plurality of natural fiber yarns, wherein the elastic core yarn is a polyurethane elastic yarn of which fineness, before integrated into the elastic composite yarn, is in a range of 78 to 1,300 dtex, wherein the sheath yarn is any of a chemical fiber yarn of which fineness is in a range of 10 to 500 dtex and a natural fiber yarn of which fineness is in a range of 100 to 1,000 dtex, wherein a fiber for composing the chemical fiber yarn for the sheath yarn is selected from a polyamide fiber, a polyester fiber, a polyolefin fiber, or a combination thereof, and wherein a fiber for composing the natural fiber yarn for the sheath yarn is a cotton fiber, characterized in that each of the elastic composite yarns is in a form of a singly-covered yarn in which the elastic core yarn is covered by a single layer of the sheath yarn helicoidally wound around a periphery of the elastic core yarn, a number of turns of the sheath yarn per 1 meter of the elastic core yarn being in a range of 1,300 to 2,500 T/m, in that each of the elastic composite yarns has the form in which the sheath yarn is helicoidally wound around the elastic core yarn as a result of being produced by a hollow spindle method, wherein the elastic core yarn is in a state of length near its original length as a result that when the elastic composite yarn is produced by the hollow spindle method, the polyurethane elastic yarn is guided to a hollow spindle while being drafted with a feed magnification factor expressed by a ratio (V2/V1) of a yarn take-up rate (V2) to a yarn feed rate (V1) of 0.8 to 1.3, in that an elongation rate of each of the elastic composite yarns is equal to or more than 30%, in that an elastic recovery rate of each of the elastic composite yarns is equal to or more than 70%, and in that a stretching magnification ratio of each of the elastic composite yarns in the elastic woven fabric in a weaving process is retained equal to or less than 1.30 folds based on the elastic composite yarn before weaving.

2. The elastic woven fabric according to claim 1 wherein the number of turns of the sheath yarn per 1 meter of the elastic core yarn in each of the elastic composite yarns is in a range of 1,300 to 2,400 T/m.

3. The elastic woven fabric according to claim 1, wherein the number of turns of the sheath yarn per 1 meter of the elastic core yarn in each of the elastic composite yarns is in a range of 1,800 to 2,200 T/m.

4. The elastic woven fabric according to claim 1, wherein a fiber for composing the sheath yarn is selected from the polyamide fiber and the polyester fiber.

5. The elastic woven fabric according to claim 1, wherein the polyester fiber is selected from a polyethylene terephthalate fiber and a polybutylene terephthalate fiber.

6. The elastic woven fabric according to claim 1, wherein the polyolefin fiber is selected from a polyethylene fiber and a polypropylene fiber.

7. The elastic woven fabric according to claim 1, wherein a washing shrinkage rate in a weft direction is equal to or less than 5%.

8. The elastic woven fabric according to claim 1, wherein the stretching magnification ratio of each of the elastic composite yarns in the elastic woven fabric in the weaving process is retained equal to or less than 1.20 folds.

9. The elastic woven fabric according to claim 1, wherein a washing shrinkage rate in a weft direction is equal to or less than 3%.

10. The elastic woven fabric according to claim 1, wherein a warp yarn density after a washing treatment is in a range of 15 to 80 pieces/cm, and wherein a yarn density of the elastic composite yarns, after the washing treatment, is in a range of 10 to 80 pieces/cm.

11. The elastic woven fabric according to claim 1, wherein an elongation rate under a constant load (JIS-L-1096) in a weft direction of the elastic woven fabric is equal to or more than 20%, and wherein an elongation recovery rate (JIS-L-1096) in the weft direction of the elastic woven fabric is equal to or more than 85%.

12. The elastic woven fabric according to claim 1, wherein the elongation rate of each of the elastic composite yarns is equal to or more than 50%, and wherein the elastic recovery rate of each of the elastic composite yarns is in a range of 80 to 100%.

13. An elastic clothing material made of an elastic woven fabric that comprises weft and warp yarns, the weft yarns including a plurality of elastic composite yarns each of which comprises an elastic core yarn and a sheath yarn covering the elastic core yarn, and the warp yarns including a plurality of chemical fiber yarns and/or a plurality of natural fiber yarns, wherein the elastic core yarn is a polyurethane elastic yarn of which fineness, before integrated into the elastic composite yarn, is in a range of 78 to 1,300 dtex, wherein the sheath yarn is any of a chemical fiber yarn of which fineness is in a range of 10 to 500 dtex and a natural fiber yarn of which fineness is in a range of 100 to 1,000 dtex, wherein a fiber for composing the chemical fiber yarn for the sheath yarn is selected from a polyamide fiber, a polyester fiber, a polyolefin fiber, or a combination thereof, and wherein a fiber for composing the natural fiber yarn for the sheath yarn is a cotton fiber, characterized in that each of the elastic composite yarns is in a form of a singly-covered yarn in which the elastic core yarn is covered by a single layer of the sheath yarn helicoidally wound around a periphery of the elastic core yarn, a number of turns of the sheath yarn per 1 meter of the elastic core yarn being in a range of 1,300 to 2,500 T/m, in that each of the elastic composite yarns has the form in which the sheath yarn is helicoidally wound around the elastic core yarn as a result of being produced by a hollow spindle method, wherein the elastic core yarn is in a state of length near its original length as a result that when the elastic composite yarn is produced by the hollow spindle method, the polyurethane elastic yarn is guided to a hollow spindle while being drafted with a feed magnification factor expressed by a ratio (V2/V1) of a yarn take-up rate (V2) to a yarn feed rate (V1) of 0.8 to 1.3, in that an elongation rate of each of the elastic composite yarns is equal to or more than 30%, in that an elastic recovery rate of each of the elastic composite yarns is equal to or more than 70%, and in that a stretching magnification ratio of each of the elastic composite yarns in the elastic woven fabric in a weaving process is retained equal to or less than 1.30 folds based on the elastic composite yarn before weaving.

14. The elastic clothing material according to claim 13, wherein the elastic woven fabric is a stretch denim having a twill weave.

15. The elastic clothing material according to claim 13, wherein the elastic woven fabric is a stretch chino cloth which has a twill weave and of which warp yarns comprise two-ply combed yarns.

16. The elastic clothing material according to claim 13, wherein the elastic woven fabric is used for a material for supporter.

17. Stretch jeans including a stretch denim made of an elastic woven fabric that comprises weft and warp yarns and has a twill weave, the weft yarns including a plurality of elastic composite yarns each of which comprises an elastic core yarn and a sheath yarn covering the elastic core yarn, and the warp yarns including a plurality of chemical fiber yarns and/or a plurality of natural fiber yarns, wherein the elastic core yarn is a polyurethane elastic yarn of which fineness, before integrated into the elastic composite yarn, is in a range of 78 to 1,300 dtex, wherein the sheath yarn is any of a chemical fiber yarn of which fineness is in a range of 10 to 500 dtex and a natural fiber yarn of which fineness is in a range of 100 to 1,000 dtex, wherein a fiber for composing the chemical fiber yarn for the sheath yarn is selected from a polyamide fiber, a polyester fiber, a polyolefin fiber, or a combination thereof, and wherein a fiber for composing the natural fiber yarn for the sheath yarn is a cotton fiber, characterized in that each of the elastic composite yarns is in a form of a singly-covered yarn in which the elastic core yarn is covered by a single layer of the sheath yarn helicoidally wound around a periphery of the elastic core yarn, a number of turns of the sheath yarn per 1 meter of the elastic core yarn being in a range of 1,300 to 2,500 T/m, in that each of the elastic composite yarns has the form in which the sheath yarn is helicoidally wound around the elastic core yarn as a result of being produced by a hollow spindle method, wherein the elastic core yarn is in a state of length near its original length as a result that when the elastic composite yarn is produced by the hollow spindle method, the polyurethane elastic yarn is guided to a hollow spindle while being drafted with a feed magnification factor expressed by a ratio (V2/V1) of a yarn take-up rate (V2) to a yarn feed rate (V1) of 0.8 to 1.3, in that an elongation rate of each of the elastic composite yarns is equal to or more than 30%, in that an elastic recovery rate of each of the elastic composite yarns is equal to or more than 70%, and in that a stretching magnification ratio of each of the elastic composite yarns in the elastic woven fabric in a weaving process is retained equal to or less than 1.30 folds based on the elastic composite yarn before weaving.

18. A method for producing an elastic woven fabric by using a gripper loom, the elastic woven fabric comprising weft and warp yarns, the weft yarns including a plurality of elastic composite yarns each of which comprises an elastic core yarn and a sheath yarn covering the elastic core yarn, and the warp yarns including a plurality of chemical fiber yarns and/or a plurality of natural fiber yarns, wherein the elastic core yarn is a polyurethane elastic yarn of which fineness, before integrated into the elastic composite yarn, is in a range of 78 to 1,300 dtex, wherein the sheath yarn is any of a chemical fiber yarn of which fineness is in a range of 10 to 500 dtex and a natural fiber yarn of which fineness is in a range of 100 to 1,000 dtex, wherein a fiber for composing the chemical fiber yarn for the sheath yarn is selected from a polyamide fiber, a polyester fiber, a polyolefin fiber, or a combination thereof, wherein a fiber for composing the natural fiber yarn for the sheath yarn is a cotton fiber, wherein each of the elastic composite yarns is in a form of a singly-covered yarn in which the elastic core yarn is covered by a single layer of the sheath yarn helicoidally wound around a periphery of the elastic core yarn, a number of turns of the sheath yarn per 1 meter of the elastic core yarn being in a range of 1,300 to 2,500 T/m, wherein each of the elastic composite yarns has the form in which the sheath yarn is helicoidally wound around the elastic core yarn as a result of being produced by a hollow spindle method, wherein the elastic core yarn is in a state of length near its original length as a result that when the elastic composite yarn is produced by the hollow spindle method, the polyurethane elastic yarn is guided to a hollow spindle while being drafted with a feed magnification factor expressed by a ratio (V2/V1) of a yarn take-up rate (V2) to a yarn feed rate (V1) of 0.8 to 1.3, wherein an elongation rate of each of the elastic composite yarns is equal to or more than 30%, wherein an elastic recovery rate of each of the elastic composite yarns is equal to or more than 70%, and wherein a stretching magnification ratio of each of the elastic composite yarns in the elastic woven fabric in a weaving process is retained equal to or less than 1.30 folds based on the elastic composite yarn before weaving, and the gripper loom comprising at least a projectile which is flown through a warp shedding in a weft direction with gripping the elastic composite yarn in order to feed the elastic composite yarn and a weft yarn brake which is provided in a feeding side of the elastic composite yarn to apply a tensile force to the elastic composite yarn pulled by the flying projectile, characterized in that the method comprises a step of blowing an air to the elastic composite yarn pulled by the flying projectile by using an air nozzle or an air blower in a direction substantially opposite to the feed direction of the elastic composite yarn in a vicinity of a downstream side of the weft yarn brake, and thereby reducing the tensile force applied by the weft yarn brake to decrease stretching of the elastic composite yarn in a weaving process.

19. The method for producing an elastic woven fabric according to claim 18, wherein the gripper loom further comprises a yarn feeding cheese made by winding the elastic composite yarn, a weft tensioner arranged in the downstream side of the weft yarn brake to control the tensile force of the elastic composite yarn pulled out from the yarn feeding cheese, a projectile feeder arranged in the further downstream side to transfer the elastic composite yarn to the projectile, and a stopping brake to stop the flying projectile, wherein these are arranged in an order of the yarn feeding cheese, the weft yarn brake, the weft tensioner, the projectile feeder and the stopping brake from the feeding side of the elastic composite yarn so that the projectile flies from the projectile feeder toward the stopping brake, and wherein the elastic composite yarn is blown with the air fed by the air nozzle or the air blower arranged between the weft tensioner and the projectile feeder.

20. An apparatus for producing an elastic woven fabric comprising weft and warp yarns, the weft yarns including a plurality of elastic composite yarns each of which comprises an elastic core yarn and a sheath yarn covering the elastic core yarn, and the warp yarns including a plurality of chemical fiber yarns and/or a plurality of natural fiber yarns, wherein the elastic core yarn is a polyurethane elastic yarn of which fineness, before integrated into the elastic composite yarn, is in a range of 78 to 1,300 dtex, wherein the sheath yarn is any of a chemical fiber yarn of which fineness is in a range of 10 to 500 dtex and a natural fiber yarn of which fineness is in a range of 100 to 1,000 dtex, wherein a fiber for composing the chemical fiber yarn for the sheath yarn is selected from a polyamide fiber, a polyester fiber, a polyolefin fiber, or a combination thereof, wherein a fiber for composing the natural fiber yarn for the sheath yarn is a cotton fiber, wherein each of the elastic composite yarns is in a form of a singly-covered yarn in which the elastic core yarn is covered by a single layer of the sheath yarn helicoidally wound around a periphery of the elastic core yarn, a number of turns of the sheath yarn per 1 meter of the elastic core yarn being in a range of 1,300 to 2,500 T/m, wherein each of the elastic composite yarns has the form in which the sheath yarn is helicoidally wound around the elastic core yarn as a result of being produced by a hollow spindle method, wherein the elastic core yarn is in a state of length near its original length as a result that when the elastic composite yarn is produced by the hollow spindle method, the polyurethane elastic yarn is guided to a hollow spindle while being drafted with a feed magnification factor expressed by a ratio (V2/V1) of a yarn take-up rate (V2) to a yarn feed rate (V1) of 0.8 to 1.3, wherein an elongation rate of each of the elastic composite yarns is equal to or more than 30%, wherein an elastic recovery rate of each of the elastic composite yarns is equal to or more than 70%, and wherein a stretching magnification ratio of each of the elastic composite yarns in the elastic woven fabric in a weaving process is retained equal to or less than 1.30 folds based on the elastic composite yarn before weaving, and the apparatus including a gripper loom comprising at least a projectile which is flown through a warp shedding in a weft direction with gripping the elastic composite yarn in order to feed the elastic composite yarn and a weft yarn brake which is provided in a feeding side of the elastic composite yarn to apply a tensile force to the elastic composite yarn pulled by the flying projectile, wherein the gripper loom further comprises a yarn feeding cheese made by winding the elastic composite yarn, a weft tensioner arranged in the downstream side of the weft yarn brake to control the tensile force of the elastic composite yarn pulled out from the yarn feeding cheese, a projectile feeder arranged in the further downstream side to transfer the elastic composite yarn to the projectile, and a stopping brake to stop the flying projectile, and wherein these are arranged in an order of the yarn feeding cheese, the weft yarn brake, the weft tensioner, the projectile feeder and the stopping brake from the feeding side of the elastic composite yarn so that the projectile flies from the projectile feeder toward the stopping brake, characterized in that the gripper loom further comprises an air nozzle or an air blower for blowing an air to the elastic composite yarn pulled by the flying projectile in a direction substantially opposite to the feed direction of the elastic composite yarn between the weft tensioner and the projectile feeder, and thereby reducing the tensile force applied by the weft yarn brake to decrease stretching of the elastic composite yarn in a weaving process, and in that a discharge pressure of a compressed air flow for blowing to the elastic composite yarn by using the air nozzle or the air blower and the tensile force applied to the elastic composite yarn by the weft yarn brake and the weft tensioner are controlled so that the stretching magnification ratio of each of the elastic composite yarns in the elastic woven fabric in the weaving process is retained equal to or less than 1.30 folds based on the elastic composite yarn before weaving.

21. The elastic woven fabric according to claim 1, wherein the elongation rate of each of the elastic composite yarns is equal to or more than 60%, and the elastic recovery rate of each of the elastic composite yarns is equal to or more than 90 to 100%.

22. The elastic woven fabric according to claim 1, wherein an elongation rate under a constant load (JIS-L-1096) in a weft direction of the elastic woven fabric is equal to or more than 47%, and wherein an elongation recovery rate (JIS-L-1096) in the weft direction of the elastic woven fabric is equal to or more than 90%.

23. The elastic woven fabric according to claim 1, wherein the elastic core yarn is in the state of length near its original length as the result that when the elastic composite yarn is produced by the hollow spindle method, the polyurethane elastic yarn is guided to the hollow spindle while being drafted with the feed magnification factor of 1 to 1.3.

* * * * *